US008336649B2

(12) United States Patent
Jones et al.

(10) Patent No.: US 8,336,649 B2
(45) Date of Patent: Dec. 25, 2012

(54) DRILL BIT FOR EARTH BORING

(75) Inventors: Mark L. Jones, Draper, UT (US); Kenneth M. Curry, South Jordan, UT (US); Jeffery T. Ross, Salt Lake City, UT (US)

(73) Assignee: Atlas Copco Secoroc LLC, Grand Prairie, TX (US)

( * ) Notice: Subject to any disclaimer, the term of this patent is extended or adjusted under 35 U.S.C. 154(b) by 337 days.

(21) Appl. No.: 12/714,481

(22) Filed: Feb. 27, 2010

(65) Prior Publication Data

US 2010/0218999 A1 Sep. 2, 2010

Related U.S. Application Data

(60) Provisional application No. 61/156,358, filed on Feb. 27, 2009.

(51) Int. Cl.
*E21B 10/46* (2006.01)

(52) U.S. Cl. ..... 175/413; 175/432

(58) Field of Classification Search ..... 175/413, 175/432

See application file for complete search history.

(56) References Cited

U.S. PATENT DOCUMENTS

| | | | | |
|---|---|---|---|---|
| 1,873,814 A | | 8/1932 | Brewster | |
| 3,519,309 A | | 7/1970 | Engle | |
| 4,337,980 A | * | 7/1982 | Krekeler | 299/102 |
| 4,440,247 A | | 4/1984 | Sartor | |
| 4,485,655 A | | 12/1984 | Ewing | |
| 4,604,106 A | | 8/1986 | Hall et al. | |
| 4,606,108 A | * | 8/1986 | Davis | 29/402.03 |
| 4,654,947 A | * | 4/1987 | Davis | 29/402.08 |
| 4,782,903 A | * | 11/1988 | Strange | 175/432 |
| 4,813,501 A | | 3/1989 | Mills et al. | |
| 4,815,342 A | | 3/1989 | Brett et al. | |
| 4,991,670 A | | 2/1991 | Fuller et al. | |
| 5,238,075 A | | 8/1993 | Keith et al. | |
| 5,366,031 A | | 11/1994 | Rickards | |
| 5,427,191 A | | 6/1995 | Rickards | |
| 5,735,360 A | | 4/1998 | Engstrom | |

(Continued)

FOREIGN PATENT DOCUMENTS

GB 2115460 9/1983

OTHER PUBLICATIONS

P.D. Spanos et al., Oil Well Drilling: A Vibrations Perspective, The Shock and Vibration Digest, Mar. 2003, pp. 81-99, vol. 35, No. 2, Sage Publications, US.

*Primary Examiner* — William P Neuder
(74) *Attorney, Agent, or Firm* — Brinks Hofer Gilson & Lione; John Bacoch

(57) ABSTRACT

Embodiments of the present invention include a drill bit configured for boring holes or wells into the earth. Embodiments include a drill bit comprised of a plurality of blades. Each of the plurality of blades includes one or more holes therethrough configured to receive a cutter that is secured therein. The cutters are secured in the hole with a removable securing device that typically prevents the cutters from being removed when the drill bit is in use but allow the cutters to be removed from the holes when the drill bit is not in use.

20 Claims, 14 Drawing Sheets

U.S. PATENT DOCUMENTS

| | | | | |
|---|---|---|---|---|
| 5,810,103 | A * | 9/1998 | Torbet | 175/413 |
| 5,906,245 | A * | 5/1999 | Tibbitts et al. | 175/426 |
| 6,109,368 | A | 8/2000 | Goldman et al. | |
| 6,131,673 | A | 10/2000 | Goldman et al. | |
| 6,246,974 | B1 | 6/2001 | Jelley et al. | |
| 6,283,234 | B1 * | 9/2001 | Torbet | 175/432 |
| 6,695,073 | B2 | 2/2004 | Glass et al. | |
| 6,942,045 | B2 | 9/2005 | Dennis | |
| 7,533,739 | B2 * | 5/2009 | Cooley et al. | 175/432 |
| 7,693,695 | B2 | 4/2010 | Huang et al. | |
| 7,735,582 | B2 * | 6/2010 | Smith | 175/340 |
| 7,882,907 | B2 | 2/2011 | Engstrom | |
| 8,011,456 | B2 * | 9/2011 | Sherwood, Jr. | 175/368 |
| 8,079,431 | B1 * | 12/2011 | Cooley et al. | 175/432 |
| 2007/0261890 | A1 | 11/2007 | Cisneros | |
| 2008/0035387 | A1 | 2/2008 | Hall et al. | |
| 2009/0020339 | A1 * | 1/2009 | Sherwood, Jr. | 175/426 |

* cited by examiner

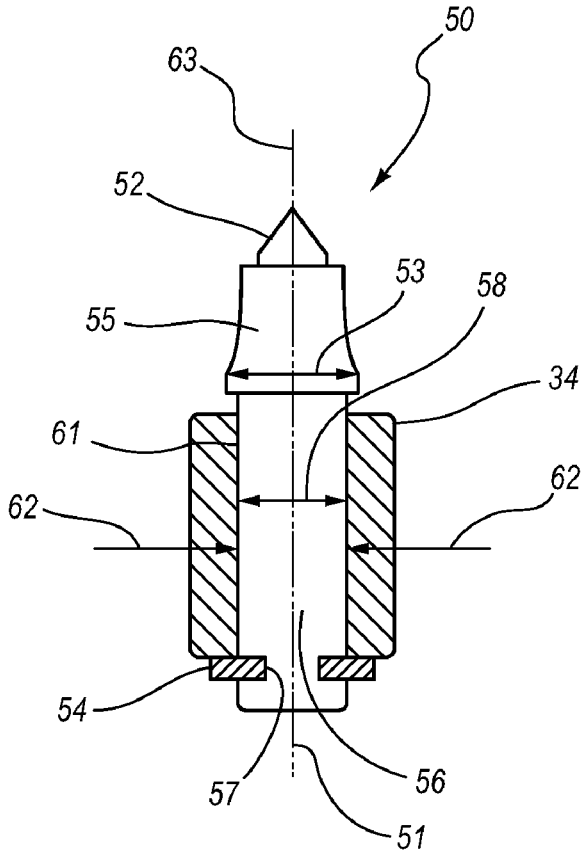
FIG. 11-A
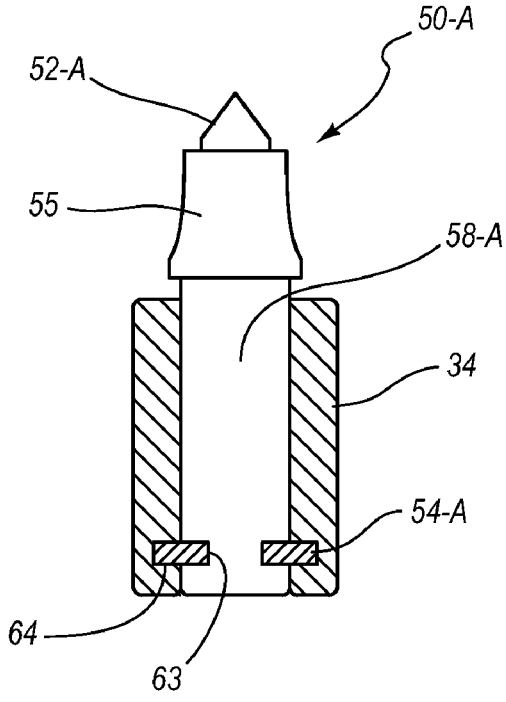
FIG. 11-B

DRILL BIT FOR EARTH BORING

PRIORITY CLAIM

This application claims the benefit of and priority from U.S. Provisional Patent Application No. 61/156,358 filed on Feb. 27, 2009 that is incorporated in its entirety for all purposes by this reference.

FIELD

The present application relates to drill bits used for earth boring, such as water wells; oil and gas wells; injection wells; geothermal wells; monitoring wells, mining; and, other operations in which a well-bore is drilled into the Earth.

BACKGROUND

Specialized drill bits are used to drill well-bores, boreholes, or wells in the earth for a variety of purposes, including water wells; oil and gas wells; injection wells; geothermal wells; monitoring wells, mining; and, other similar operations. These drill bits come in two common types, roller cone drill bits and fixed cutter drill bits.

Wells and other holes in the earth are drilled by attaching or connecting a drill bit to some means of turning the drill bit. In some instances, such as in some mining applications, the drill bit is attached directly to a shaft that is turned by a motor, engine, drive, or other means of providing torque to rotate the drill bit.

In other applications, such as oil and gas drilling, the well may be several thousand feet or more in total depth. In these circumstances, the drill bit is connected to the surface of the earth by what is referred to as a drill string and a motor or drive that rotates the drill bit. The drill string typically comprises several elements that may include a special down-hole motor configured to provide additional or, if a surfaces motor or drive is not provided, the only means of turning the drill bit. Special logging and directional tools to measure various physical characteristics of the geological formation being drilled and to measure the location of the drill bit and drill string may be employed. Additional drill collars, heavy, thick-walled pipe, typically provide weight that is used to push the drill bit into the formation. Finally, drill pipe connects these elements, the drill bit, down-hole motor, logging tools, and drill collars, to the surface where a motor or drive mechanism turns the entire drill string and, consequently, the drill bit, to engage the drill bit with the geological formation to drill the well-bore deeper.

As a well is drilled, fluid, typically a water or oil based fluid referred to as drilling mud is pumped down the drill string through the drill pipe and any other elements present and through the drill bit. Other types of drilling fluids are sometimes used, including air, nitrogen, foams, mists, and other combinations of gases, but for purposes of this application drilling fluid and/or drilling mud refers to any type of drilling fluid, including gases. In other words, drill bits typically have a fluid channel within the drill bit to allow the drilling mud to pass through the bit and out one or more jets, ports, or nozzles. The purpose of the drilling fluid is to cool and lubricate the drill bit, stabilize the well-bore from collapsing or allowing fluids present in the geological formation from entering the well-bore, and to carry fragments or cuttings removed by the drill bit up the annulus and out of the well-bore. While the drilling fluid typically is pumped through the inner annulus of the drill string and out of the drill bit, drilling fluid can be reverse-circulated. That is, the drilling fluid can be pumped down the annulus (the space between the exterior of the drill pipe and the wall of the well-bore) of the well-bore, across the face of the drill bit, and into the inner fluid channels of the drill bit through the jets or nozzles and up into the drill string.

Fixed cutter drill bits that employ very durable polycrystalline diamond compact (PDC) cutters, tungsten carbide cutters, natural or synthetic diamond, or combinations thereof, have been developed. These bits are referred to as fixed cutter bits because they employ cutting elements positioned on one or more fixed blades in selected locations or randomly distributed. Unlike roller cone bits that have cutting elements on a cone that rotates, in addition to the rotation imparted by a motor or drive, fixed cutter bits do not rotate independently of the rotation imparted by the motor or drive mechanism. Through varying improvements, the durability of fixed cutter bits has improved sufficiently to make them cost effective in terms of time saved during the drilling process when compared to the higher, up-front cost to manufacture the fixed cutter bits.

Once used, fixed cutter bits can be repaired if they are not badly damaged during the drilling process. Unfortunately, those repairs typically require an expensive maintenance facility with special tools. In other words, fixed cutter bits cannot typically be repaired in the field for even minor damage, such as a single, broken cutter. Thus, there exists a need for a drill bit that is more easily repairable in the field.

In addition, previous designs of drill bits that were repairable in the field to a limited degree often suffered from structural failures for various reasons, resulting in more, different problems than the limited ability to repair the bit in the field solved. Thus, there exists a need for a more robust, field-repairable drill bit.

Further, field-repairable drill bits presently used typically suffer from problems with stability. In other words, the field-repairable drill bits are stable in only a limited variety of conditions, and often undergo what is referred to as whirl, which often is characterized by shocks, or chaotic movement within the well-bore that takes the form of suddenly stopping, i.e., rotation momentarily ceases at the drill bit but not within the drill string; sudden release of the energy stored within the drill string when the bit begins to rotate again; uncontrolled and rapid movement laterally against the wall of the well-bore; and bouncing, or rapid movement in the longitudinal direction parallel to the long axis of the well-bore. The severity of these movements can exceed 100 times the force of gravity and damage the drill bit, the drill string, surface equipment, and other items. In addition, the excess energy released in these various shocks is not used to drill the well-bore, resulting in slower rates of drilling, or rate-of-penetration (ROP), leading to increased drilling costs.

Various methods have been attempted to reduce the occurrence of whirl, but none have been wholly satisfactory. Computer modeling to balance the anticipated forces on the drill bit provides some improvement, but cannot account for the variety of factors encountered during the drilling process. Using more, smaller diameter cutting elements and more blades on the bit improves the stability of the bit because there exist more points of contact between the drill bit and the well-bore, but such a configuration typically costs more to manufacture and reduces the rate at which the fixed cutter bit drills the well-bore, thereby increasing the total cost. Conversely, using a fixed cutter bit with larger diameter cutting elements and fewer blades and/or fewer number of cutters typically improves the rate-of-penetration and lowers the cost to manufacture the bit, but stability is reduced.

In addition to resisting the tendency to whirl, the drill bit is part of a dynamic system with both known and unknown inputs. While the inputs into the system at the surface may be known, e.g., type of bit, force or weight applied to the bit at the surface, torque applied at the surface, the actual effect of these surface inputs is typically more variable and less predictable at the drill bit and is only occasionally known through the use of specialized measurement tools located near the drill bit that are capable of transmitting that information to the driller/user at the surface. Such specialized tools are rarely run because of the cost, thus the actual conditions and inputs to which the bit is exposed is typically unknown or known only in partial detail, thus requiring educated guess-work to modify the inputs to improve the operation of the drill bit.

Unfortunately, drill bits typically have a small range of operating conditions in which they operate effectively, such as remaining stable while rotating (which is more than just avoiding whirl) and efficiently drilling subsurface geological formations. Thus, there exists a need for a drill bit that operates efficiently and remains rotational stable over a wide range of conditions.

Thus, there exists a need for a cost-effective, robust, field-repairable drill bit that provides improved stability without sacrificing rate-of-penetration.

SUMMARY

Embodiments of the present invention include a drill bit that includes a connection that allows for the drill bit to be removably attached to a means of providing a rotational force. The drill bit includes a body that includes a plurality of blades positioned thereabout. The plurality of blades each have one or more removable cutters or cutting elements positioned therein, the plurality of cutting elements typically of the type referred to as polycrystalline diamond compacts, or PDCs, tungsten carbide, synthetic or natural diamond, and other hard materials, or a combination thereof.

Another embodiment of the invention includes a plurality of blades with one or more removable cutters or cutting elements positioned on each blade at a selected radial distance from centerline of the drill bit with a selected side rake and back rake as will be discussed below. The cutters or cutting elements are each positioned within a through hole within a blade configured to receive a portion of the cutter. The cutter is held in the through hole through securing means, which may include one or more securing means, to allow the cutter to be removed from the blade, such as when it is to be replaced, by a user as desired while preventing unintended or accidental removal from the blade during use.

Other configurations of the blades, blade portions, and cutting elements, are disclosed herein and fall within the scope of the disclosure. In addition, methods of manufacturing various embodiments of the drill bit are disclosed herein.

As used herein, "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" means A alone, B alone, C alone, A and B together, A and C together, B and C together, or A, B and C together.

Various embodiments of the present inventions are set forth in the attached figures and in the Detailed Description as provided herein and as embodied by the claims. It should be understood, however, that this Summary does not contain all of the aspects and embodiments of the one or more present inventions, is not meant to be limiting or restrictive in any manner, and that the invention(s) as disclosed herein is/are and will be understood by those of ordinary skill in the art to encompass obvious improvements and modifications thereto.

Additional advantages of the present invention will become readily apparent from the following discussion, particularly when taken together with the accompanying drawings.

BRIEF DESCRIPTION OF THE DRAWINGS

To further clarify the above and other advantages and features of the one or more present inventions, reference to specific embodiments thereof are illustrated in the appended drawings. The drawings depict only typical embodiments and are therefore not to be considered limiting. One or more embodiments will be described and explained with additional specificity and detail through the use of the accompanying drawings in which:

FIG. 11-A is a view of cross-section B-B of a typical cutting element used in embodiments of the drill bit;

FIG. 11-B is a view of cross-section B-B of another embodiment of a cutting element used in embodiments of the drill bit;

The drawings are not necessarily to scale.

DETAILED DESCRIPTION

FIGS. 1-6 illustrate various views and embodiments of a drill bit 10 configured to drill well-bores in the earth. The drill bit 10 is useful for drilling oil and gas wells onshore and offshore; geothermal wells; water wells; monitoring and/or sampling wells; injection wells; directional wells, including horizontal wells; bore holes in mining operations; bore holes for pipelines and telecommunications conduits; and other types of wells and boreholes.

Figure 1:
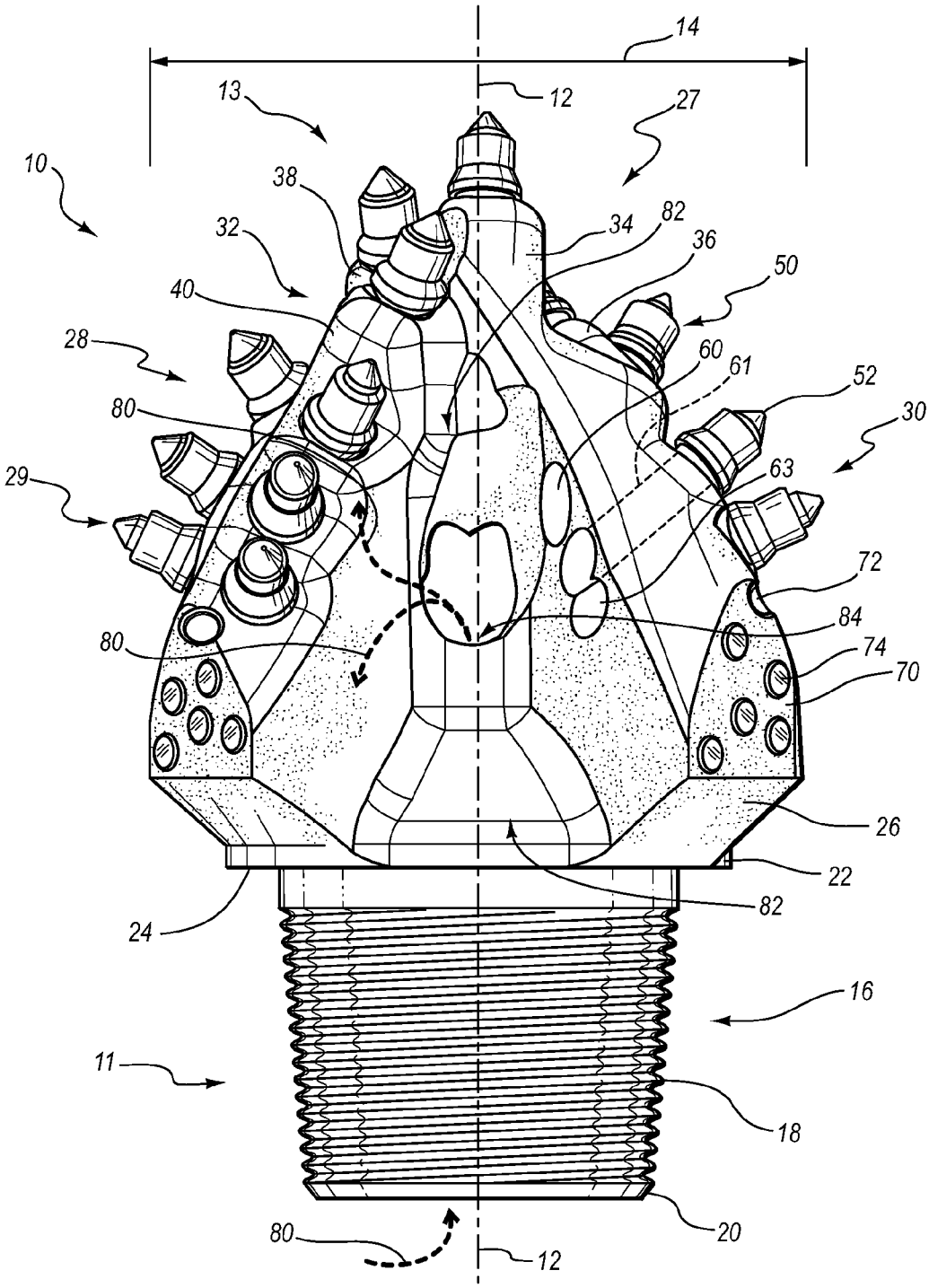
FIG. 1 is a side-view of an embodiment of the drill bit.

The drill bit 10 includes a first end 11 that includes a shank or connection means 16 configured to couple or mate the drill bit 10 to a drill string or a drill shaft that is coupled to a means of providing rotary torque or force, such as a motor, downhole motor, drive at the surface, or other means, as described above in the background. FIG. 1 illustrates a typical pin connection with threads 18 that have a chamfer 20 configured to reduce stress concentrations at the end of the threads 18 and to ease mating with the box connection in the drill string, a shank shoulder 22, and the sealing face 24 of the connection 16. Of course, the connection means can be a box connection described further below, bolts, welded connection, joints, and other means of connecting the drill bit 10 to a motor, drill string, drill, top drive, downhole turbine, or other means of providing a rotary torque or force. The threads typically are of a type described as an American Petroleum Institute (API) standard connection of various diameters as known in the art, although other standards and sizes fall within the scope of the disclosure. The threads 18 are configured to operably couple with the threads of a corresponding or analogue box connection in the drill string, collar, downhole motor, or other connection to the bit as known in the art. The sealing face 24 provides a mechanical seal between the drill bit 10 and the drill string and prevents any drilling fluid passing through the inner diameter of the drill string and the drill bit 10 from leaking out.

Figure 2:
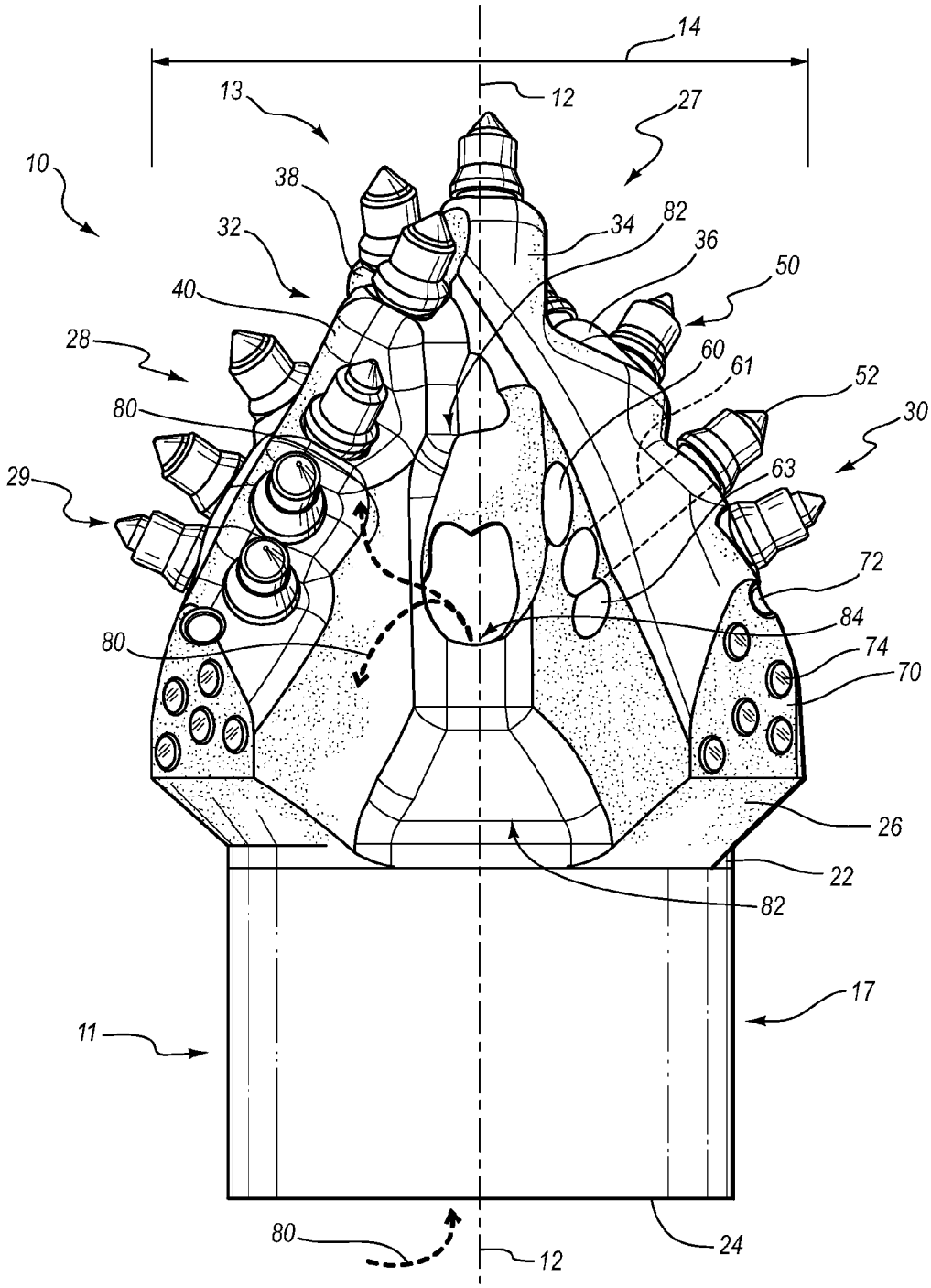
FIG. 2 is side-view of an alternative embodiment of the drill bit illustrated in FIG. 1.

FIG. 2 illustrates another embodiment of the drill bit 10 that uses a box connection 17 rather than the pin connection 16 illustrated in FIG. 1. The box connection 17 configuration is less common, although it still falls within the scope of the disclosure. The box connection 17 has internal threads (not shown) similar to the external threads 18 of the pin connection 16 illustrated in FIG. 1. The box connection 17 typically is of a type described as an American Petroleum Institute (API) standard connection of various diameters as known in the art, although other standards and sizes fall within the scope of the disclosure. The threads of the box connection 17 are configured to operably couple with the threads of a corresponding or analogue pin connection in the drill string, collar, downhole motor, or other connection to the bit as known in the art.

The embodiments of the drill bit 10 optionally includes a breaker slot (not illustrated) configured to accept a bit breaker therein. The bit breaker is used to connect or mate the drill bit 10 to the drill string and provides a way to apply torque to the drill bit 10 (or to prevent the drill bit 10 from moving as torque is applied to the drill string) while the drill bit 10 and the drill string are being coupled together or taken apart.

The bit body 30 includes the one or more drill bit blades 32 connected thereto that optionally extend past the bit body 30 in both a radial direction from the centerline 12 and a vertical direction towards and proximate to the second end 13 of the drill bit 10 as illustrated in FIG. 1, the bit body 30 being attached or fixedly coupled to the connection 16, 17. The bit body 30 can be formed integrally with the drill bit blades 32, such as being milled out of a single steel blank. Alternatively, the drill bit blades 32 can be welded to the bit body. Another embodiment of the bit body 30 and blades 32 is one formed of a matrix sintered in a mold of a desired shape under temperature and pressure, typically a tungsten carbide matrix with a nickel binder, with drill bit blades 32 also integrally formed of the matrix with the bit body 30. A steel blank in the general shape of the bit body 30 and the drill blades 32 can be used to form a scaffold and/or support structure for the matrix. The bit body 30 also can be formed integrally with the connection 16, 17 from a steel blank or a steel connection 16, 17 can be welded to the bit body 30.

The drill bit 10 includes one or more blades 32 that includes a cone section 27 within a first radius proximate the centerline 12 of the drill bit 10; a blade flank section 28 spaced laterally away at a greater radial distance from the centerline 12 than the cone section 27; a blade shoulder section 29 spaced further laterally away at a greater radial distance from the centerline 12 than the blade flank section 28; and a gauge (or gage) pad 70 typically proximate the greatest radial distance, or one-half the bit diameter 14 of the drill bit 10, from the centerline 12 and proximate the bit body 30. In other embodiments, the gauge pad 70 is less than the greatest radial distance. The gauge pad 70 optionally includes a crown chamfer 26 adjacent to the bit body 30.

The relative positions of the cone section 27, blade flank section 28, blade shoulder section 29, and gauge pad section 70 with respect to the bit centerline 12 are better illustrated in the diagram of various blade profiles 600 illustrated in FIG. 16 as will be discussed in further detail below.

Returning to FIGS. 1-4, the drill bit 10 with blades 32 is illustrated to have four distinct blades 34, 36, 38, and 40 that are best illustrated in FIG. 4. Each of the blades 34, 36, 38, and 40 is slightly different for the reasons that will be discussed below with respect to FIG. 15, including the shape of each blade and the placement of the cutters 50 along the blades. The blades 32 can have a shape selected for various factors, including the formation drilled, the size of the hole desired, the capability of the equipment (drilling rig, drill string, etc.), cost, and other considerations.

A particular embodiment of the drill bit 10 includes a plurality of blades 32 that have one or more cutters 50 located on each blade 34, 36, 38, and 40. The cutters 50 are configured to pass at least partially through holes 61 that are configured to receive a cutter 50 as will be explained with respect to FIG. 11 below. The cutters 50 are configured to be positioned with the through holes 61 and removed from the through holes 61 in a field location, such as a mine, oil rig, or other wellsite. In other words, the cutters 50 can be replaced in the drill bit 10 in order to repair damaged or broken cutters 50, change one type of cutters 50 suitable for a particular geological formation or purpose for those of another type suitable for another geological formation or purpose. Thus, the purpose and capability of a particular drill bit 10 can be adjusted in the field by changing the cutters 50, making the drill bit 10 more cost-effective and useful.

Embodiments of the drill bit include through holes 61 through the blades 32 and cutters 50 held therein by securing means 54 as will be described in greater detail below, improving the likelihood that cutters 50 will be retained during drilling rather than possibly becoming damaged and/or breaking and falling to the bottom of the well-bore were it could become harmful debris that causes further damage to the drill bit 10. Further, through holes 61 created within the blades 32 improves the structural integrity and strength as compared to other methods previously used to attach removable cutters to a drill bit, such as welded blocks. In addition, the tolerance, quality, and repeatability of the dimensions are improved with such a configuration as compared to conventional drill bits because the placement of the cutters is more precise. In addition, the orientation of the through holes 61 and, consequently, the cutters 50, can be more accurately located, allowing for improved placement of the cutters 50 relative to a desired purpose of the bit, e.g., optimizing the orientation of the cutters 50 for a particular geological formation and its geophysical properties, equipment used to drill the well, depth to be drilled, balancing the forces on the cutters 50 and the drill bit 10, minimizing the likelihood whirl or other problems with stability occur, and other similar considerations.

Previous methods of attaching removable cutters to a drill bit, such as blocks welded to the bit body, have typically proved problematic in use because they often do not satisfactorily meet the points discussed above. Therefore, there is a long, unmet need in the industry that has been repeatedly expressed by drillers and other users of previous types of drill bits.

FIG. 11-A illustrates an embodiment of a cutter 50 suitable for use in the drill bits of the type disclosed here, examples of which include those available from Mills Machine Co., Inc. of Shawnee, Okla. The cutter 50 with the cutting element 52 can be made of a polycrystalline diamond compact (PDC), tungsten carbide, natural or synthetic diamond, hardened steel, regular steel, and other hard materials or combination of materials, such as a carbide cutting element 52 in a steel body portion 55. The cutter 50 includes a body portion 55, typically, although not necessarily, configured to have a diameter 53 slightly larger than the diameter 58 of the shaft 56 of the cutter 50. The diameter 58 of the shaft 56 is typically, although not necessarily, equal to or less than the diameter 62 of the through hole 61 formed in the blade 34, for example. Alternatively, the diameter 58 is large enough to form a press-fit or interference-fit with the diameter 62. More typically, the diameter 58 is sufficiently less than the diameter 62 so that the cutter 50 is capable of rotating within the through hole 61, but not so much less as to cause the cutter to wobble or rattle within the through hole 61. In other words, a central axis 51 of the cutter 50 remains substantially coincident with the central axis 63 of the through hole 61. Further, a diameter 58 of this dimension allows the insertion and removal of the cutter 50 into the through hole 61 at a field location with pulling tools, slide hammers, other hammers, and similar hand tools, without the use of specialized equipment The shaft 56 of the cutter 50 includes a groove 57 located in the shaft 56 such that the groove 57 typically extends just slightly past the bottom of the through hole 61. A removable securing device 54 is used to secure the cutter 50 in the through hole 61. Typically, the securing device 54 is a clip, such as a c-clip, spring ring, O-rings, and other similar resilient retaining device that clips to the groove 58 and extends past the diameter 62 of the through hole 61. In this configuration, the securing device 54 prevents the cutter 50 from falling out of the through hole 61 when in position in the groove 57, especially in view of the wider diameter 53 of the body 55 of the cutter 50 that also prevents the cutter 50 from falling out of the through hole 61.

Of course, other configurations for the cutter 50 are possible. For example, in FIG. 11-B an optional configuration of cutter 50-A includes a groove 64 on the inner diameter 62 of the through hole 61 configured to receive a securing device 54-A, such as a c-clip, spring ring, O-rings, and other similar resilient contracting and expanding rings and clips that can securely retain the cutter 50 in the hole 61. In such a configuration, the shaft 58-A optionally does not extend past the bottom of the through hole 61 and terminates before exiting the through hole 61. An optional plug 63, such as a threaded plug, could be inserted at the bottom of the through hole 61 to prevent drilling mud and/or other debris from becoming caked within the through hole 61 and to prevent the drilling mud from eroding the bottom of the shaft 58-A. Other configurations are also possible.

The cutters 50 are positioned on the various blades 32 at a selected radial distance from the centerline 12 depending on various factors, including the desired rate-of-penetration, hardness and abrasiveness of the expected geological formation or formations to be drilled, and other factors. For example, two or more cutters 50 may be placed at the same radial distance from the centerline 12, typically on different blades 32, such as blade 34 and blade 38, and, therefore, would cut over the same path through the formation. Another embodiment includes positioning two or more cutters 50 at only slightly different radii from the centerline 12 of the drill bit 10, again, typically on different blades 32, so that the path that each cutter makes through a geological formation overlaps slightly with the cutter at the next further radial distance from the centerline of the drill bit 10.

In addition, the distance a given cutter 50 travels during a single revolution of the drill bit 10 increases as the radial distance of the cutter 50 from the centerline 12 of the drill bit 10 increases. Thus, a cutter 50 positioned at a greater radial distance from the centerline 12 of the drill bit 10 travels a greater distance for each revolution than another cutter 50 positioned at a lesser radial distance from the centerline 12. As such, the first cutter 50 at the greater radial distance would wear faster than the second cutter 50 at the lesser radial distance. In view of this, relatively more cutters 50 are typically positioned relatively more closely, i.e., with relatively less radial distance separating those cutters 50 at adjacent radial distances (even if on different blades 32) the greater the absolute radial distance from the centerline 12 (e.g., those cutters in the blade shoulder section 29) as compared to those cutters 50 positioned at relatively shorter radial distance, i.e., closer to the centerline 12 of the drill bit 10 (e.g., those cutters 50 in the cone section 27). Further, as a radial distance of a given cutter 50 increases, other factors related to the cutter 50 position are typically, although not necessarily, selected to be less aggressive, including the exposure, back-rake, and side-rake, as described below.

Figure 12:
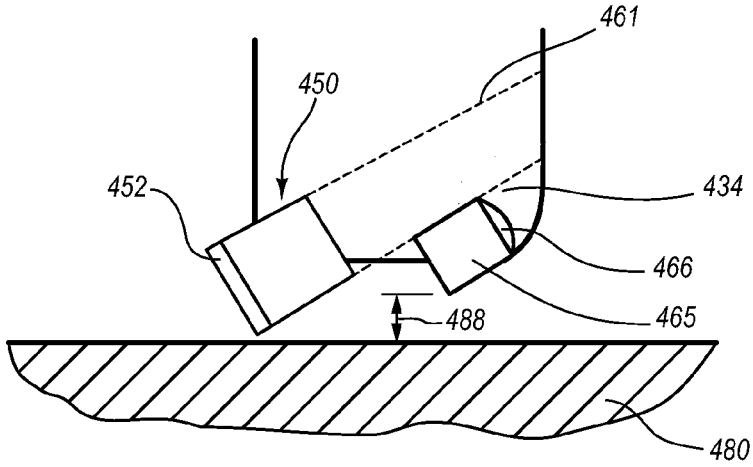
FIG. 12 is a close-view of a cutting element employed in embodiments of the invention.
Figure 13:
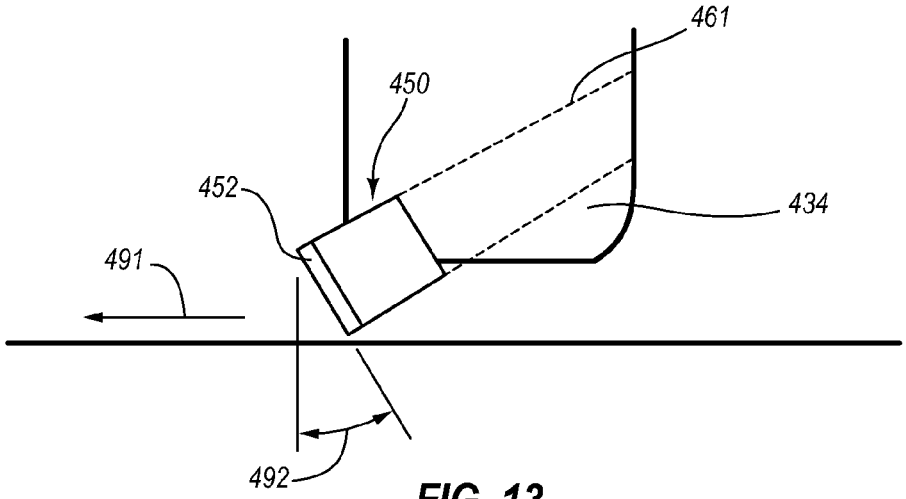
FIG. 13 is a close-view of a cutting element employed in embodiments of the invention.
Figure 14:
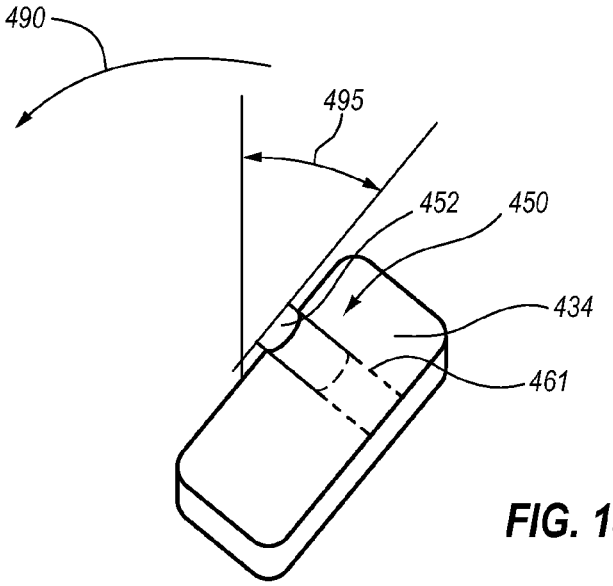
FIG. 14 is a close-view of a cutting element employed in embodiments of the invention.

FIGS. 12, 13, and 14 illustrate various factors related to cutter placement that are considered in their placement in various embodiments illustrated herein. An idealized representation of a cutter 450 illustrated in FIG. 12 cuts or drills the geological formation 480. The cutter 50 with a cutting element 452 is positioned in the through hole 461 of the blade 434. Of course, other types of cutters as discussed above fall within the scope of the disclosure. Also illustrated in FIG. 12 is an optional backup cutter 465 of a similar hard material as that in the cutter 450 (e.g., in can be one of the types of materials and others known in the art as discussed above, but it need not be the same material as the cutter 450) that can be positioned at approximately the same radial distance from the centerline of the drill bit as the cutter 450 and is typically positioned behind the cutter 450 relative to the direction of rotation of the drill bit on the same blade 434 as illustrated or on another blade of the drill bit. A given backup cutter 465 for a given cutter 450, however, may be positioned in front (relative to the direction of rotation of the drill bit) of the cutter 450 either on the same blade 434 or another blade of the drill bit. The backup cutter 465 illustrated is formed of tungsten carbide and is positioned in pocket 466 of the blade 434. The backup cutter 465 can alternatively be a PDC cutter, synthetic or natural diamond, or other hard cutting element. Typically, the backup cutter is smaller in size or diameter than the primary cutter 450, but the backup cutter can also be the same size and/or diameter as the primary cutter 450, or larger in size and/or diameter than the primary cutter 450.

The backup cutter 465 illustrated can be positioned a distance 488 from the geological formation 480 initially, i.e., before drilling begins. Typically, the backup cutter 465 only begins to engage the geological formation 480 when the cutter 450 wears sufficiently such that the backup cutter 465 begins to drill the geological formation 480. When the backup cutter 465 engages the geological formation 480, it bears a portion of the torque and weight on bit (the force on the bit in a direction parallel to the well-bore) that would otherwise have been borne solely by the cutter 450, thereby reducing the wear on the cutter 450 and increasing the life of the cutter 450. While the distance 488 is illustrated as allowing some distance between the geological formation 480 and the backup cutter 465 when the cutter 450 is new (i.e., unworn), the backup cutter 465 can be positioned to engage the geological formation 480 concurrently with the cutter 450 when the cutter 450 is new, i.e., the distance 488 is effectively zero. In other embodiments, the backup cutter 465 can be designed to engage the geological formation 480 before the cutter 450 does so, i.e., the distance 488 is effectively negative. The distance 488 is selected in consideration of the characteristics of the geological formation to be drilled and other factors known in the art and may vary among different backup cutters at different radial distances from the center of the drill bit.

The cutter 450 illustrated in FIG. 13 is positioned in the through hole 461 of the blade 434 that travels in the direction 491. The angle 492 describes the back-rake of the cutting element 452 relative to the direction of travel 491. The back-rake angle 492 illustrated in FIG. 13 is a negative angle and is considered to be less aggressive and suitable for relatively harder geological formations. A back-rake angle of zero degrees corresponds to the cutting element 452 perpendicular to the direction of travel 491 and is more aggressive and suitable for relatively softer geological formations than a negative back-rake angle. A positive back-rake angle is even more aggressive than a back-rake angle of zero degrees and is suitable for respectively softer geological formations. Thus, the back-rake angle of a selected cutter is chosen in consideration of various factors, including its radial distance from the center of the drill bit, the characteristics of the geological formation to be drilled (abrasiveness, hardness, and others known in the art), and the like.

FIG. 14 illustrates the side-rake angle 495 of a cutting element 452 of a cutter 450 relative to the direction of rotation 490. The side-rake angle 495 illustrated in FIG. 14 is a negative angle. A side-rake angle of zero degrees corresponds to the cutting element 452 perpendicular to the direction of rotation 490. A positive side-rake angle is even more aggressive than a side-rake angle of zero degrees. Thus, the side-rake angle of a selected cutter is chosen in consideration of various factors, including its radial distance from the center of the drill bit, the characteristics of the geological formation to be drilled (abrasiveness, hardness, and others known in the art), and the like.

Returning to FIGS. 1-4, the drill bit 10 optionally includes a gauge pad 70 typically positioned a radial distance from the centerline 12 of one-half of the gauge diameter 14. In other embodiments, the gauge pad 70 is positioned at less than the greatest radial distance, i.e., less than one-half the gauge diameter 14. The gauge pad 70 optionally includes gauge protection 74, which can be hard-facing and/or a selected pattern of tungsten carbide, PDC, natural or synthetic diamond, or other hard materials to provide increased wear-resistance to the gauge pad 70 to increase the probability that the drill bit 10 substantially retains its gauge diameter 14. The gauge pad 70 also optionally includes a crown chamfer 26 that forms the transition between the gauge pad 70 and the bit body 30.

Drill bit 10 optionally includes one or more gauge cutters 72 positioned in the blade shoulder section 29 to provide backup to the cutters 50 at the greatest radial distance from the centerline 12 of the drill bit 10, similar to the backup cutter 465 described above in FIG. 12. Optionally, the gauge cutter 72 can be positioned behind or below a selected cutter 50 or on a separate or different gauge pad 70. The gauge cutter 72 typically is of a smaller size and/or diameter than the cutters 50, but the gauge cutter 72 can also be the same size and/or diameter or a larger size and/or diameter than the cutters 50. The gauge cutter 72 can be formed of tungsten carbide, PDC, synthetic or natural diamond, or other hard material, or combinations thereof.

Other features of the drill bit 10 include one or more nozzles, jets, or ports 84 formed as an integral part of the bit body 30. As illustrated the jets or ports 84 have a fixed area through which drilling mud 80 flows after passing through an inner diameter of the drill string and through the inner diameter or annulus 85 of length 86 of the drill bit 10 (illustrated best in FIG. 5). The nozzles, jets, or ports 84 optionally can be configured to accept jet nozzles of various sizes that are typically field replaceable to adjust the total flow area of the nozzles or ports 84. If the port 84 is configured to accept jet nozzles of different diameters, the port 84 optionally includes threads or other means to secure the jet nozzle in position as known in the art. The jet nozzles are typically field replaceable and have a selected diameter chosen to balance the expected rate-of-penetration and, consequently, the rate at which drill cuttings are created by the bit and removed by the drilling fluid, the necessary hydraulic horsepower, and capabilities of the drilling rig facilities, particularly the pressure rating of the drilling rig's fluid management system and the pumping capacity of its mud pumps, among other factors.

Figure 4:
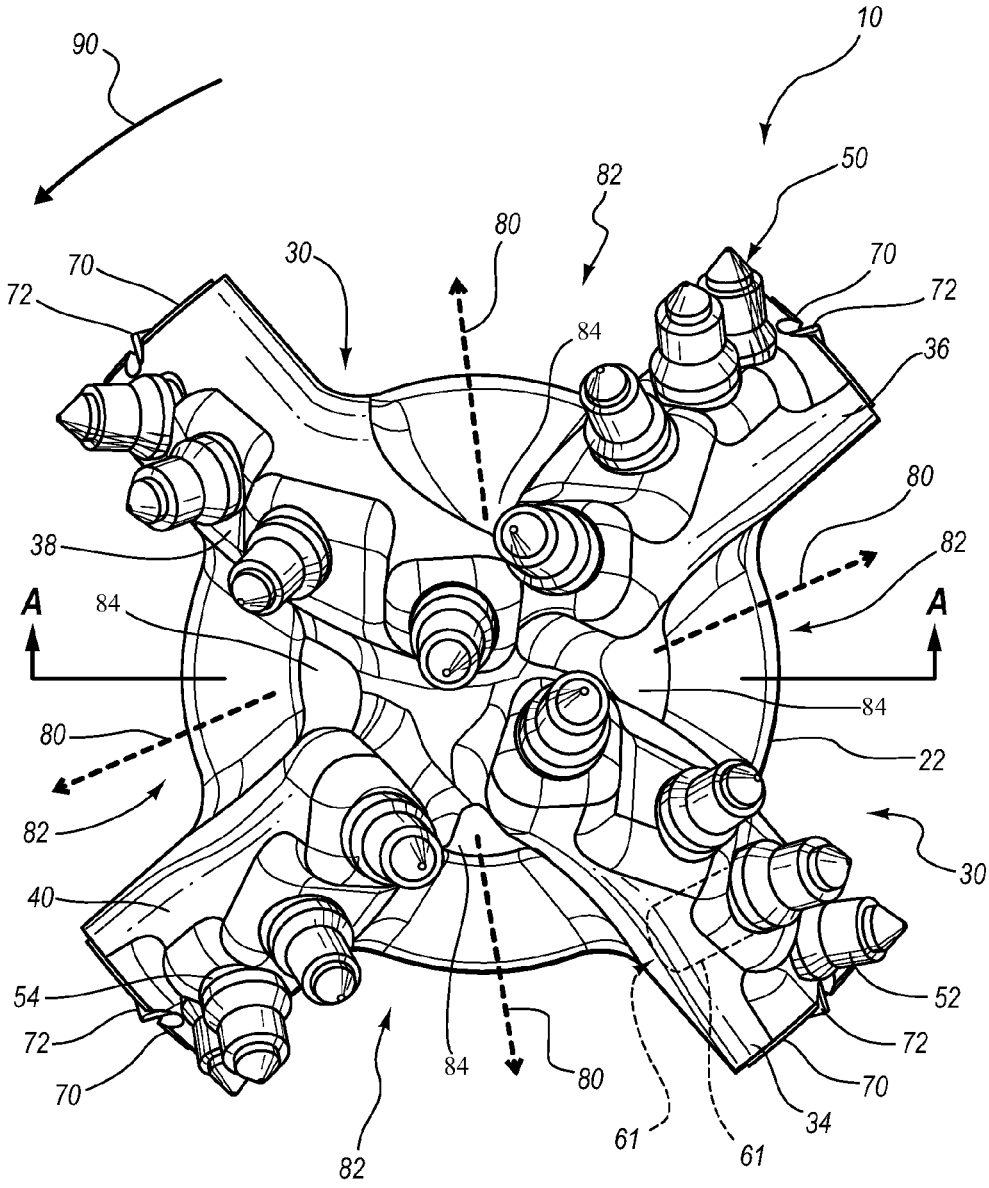
FIG. 4 is a top-view of the embodiment of the drill bit illustrated in FIG. 1.
Figure 5:
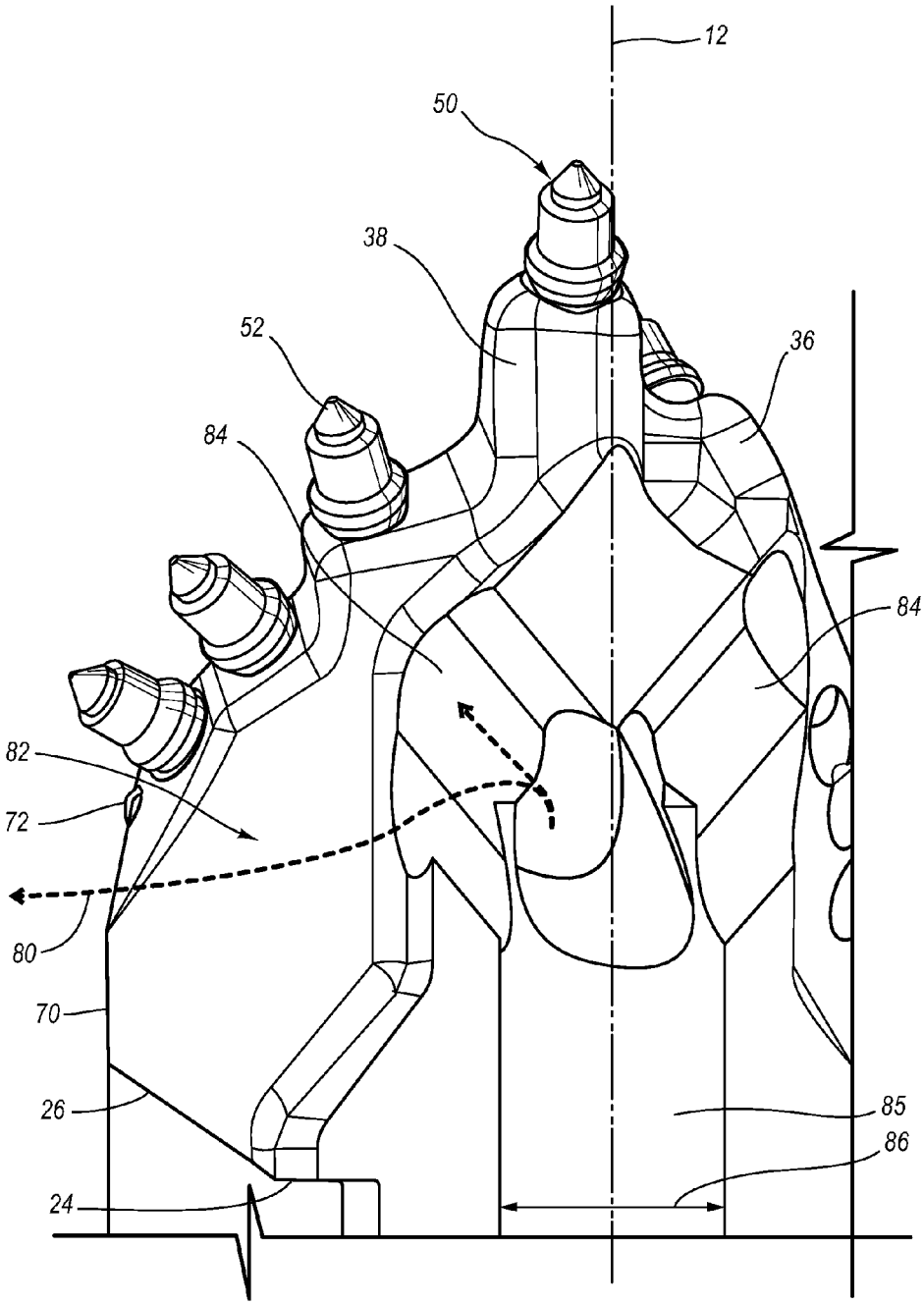
FIG. 5 is a cross-section A-A of the embodiment of the bit body 30 of the drill bit illustrated in FIG. 4.

The flow path of the drilling fluid 80 is best illustrated in FIGS. 4 and 5. As illustrated, the various jets or ports 84 have an orientation selected to enhance the removal of drill cuttings from the face of each blade 32 and from the cone section 27 of the bit and move them towards the annulus of the well-bore. Stated differently, the orientation of the jets or ports 84 is such that the drilling fluid 80 cleans the cutters 50 and the blades 34, 36, 38, and 40 of the drill bit 10. While four nozzles or ports 84 exist, one between each blade 34, 36, 38, and 40, either more or fewer nozzles, jets, or ports 84 can be used as selected for a given situation.

The drilling fluid 80 flows through the fluid channels or junk slots 82, which are sized and positioned relative to the blades 34, 36, 38, and 40 based on the expected rate-of-penetration, characteristics of the geological formation, particularly hardness and whether the formation swells or expands in the presence of the drilling fluid used, average size of the formation cuttings created, and other factors known in the art. For example, smaller (i.e., narrower) fluid channels 82 result in a higher fluid velocity with the result that formation cuttings are carried away more easily and quickly from the drill bit 10. However, smaller fluid channels or junk slots 82 raise the risk that one or more of the fluid channels 82 would become blocked by the formation cuttings, resulting in premature or uneven wear of the bit, reduced rate-of-penetration, and other negative effects. Of course, as discussed above, the drilling fluid 80 can flow through the drill string and out the nozzles or ports 84 as is typical, or it can be reverse circulated down the annulus, into the nozzles or ports 84, and up the drill string.

Figure 6:
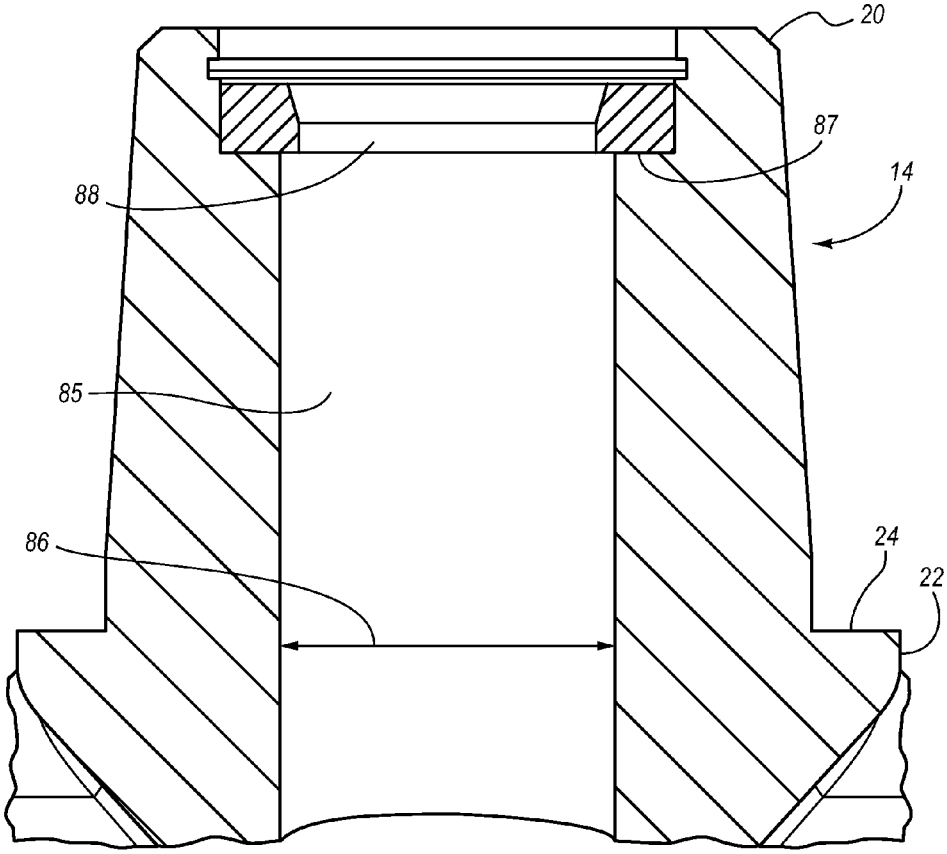
FIG. 6 is a cross-section A-A of the pin connection 16 of the embodiment of the drill bit illustrated in FIG. 4.

Turning to FIG. 6, the cross-section A-A of the pin connection 14 is illustrated, as is the inner annulus 85 having a diameter 86 of the drill bit 10. The inner annulus 85 includes a inner annulus shoulder 87 configured to optionally receive a flow washer 88 with a selected diameter. The flow washer 88 can be used to adjust the flow rate, velocity, and pressure drop of the drilling fluid 80 as it flows through the flow washer 88 through the inner annulus 85 and out the nozzles or ports 84. Flow washers 88 of different diameters can be selected and replaced in the field to adjust for different flow conditions, much like the jet nozzles can be adjusted as described above. The flow washer 88 optionally includes a key slot configured to orient the flow washer in a given direction in the drill bit 10 and a landing mechanism that is sometimes referred to as a crow's foot that is configured to receive a directional drilling device or aid, such as a gyroscope and other directional drilling devices known in the art.

Figure 3:
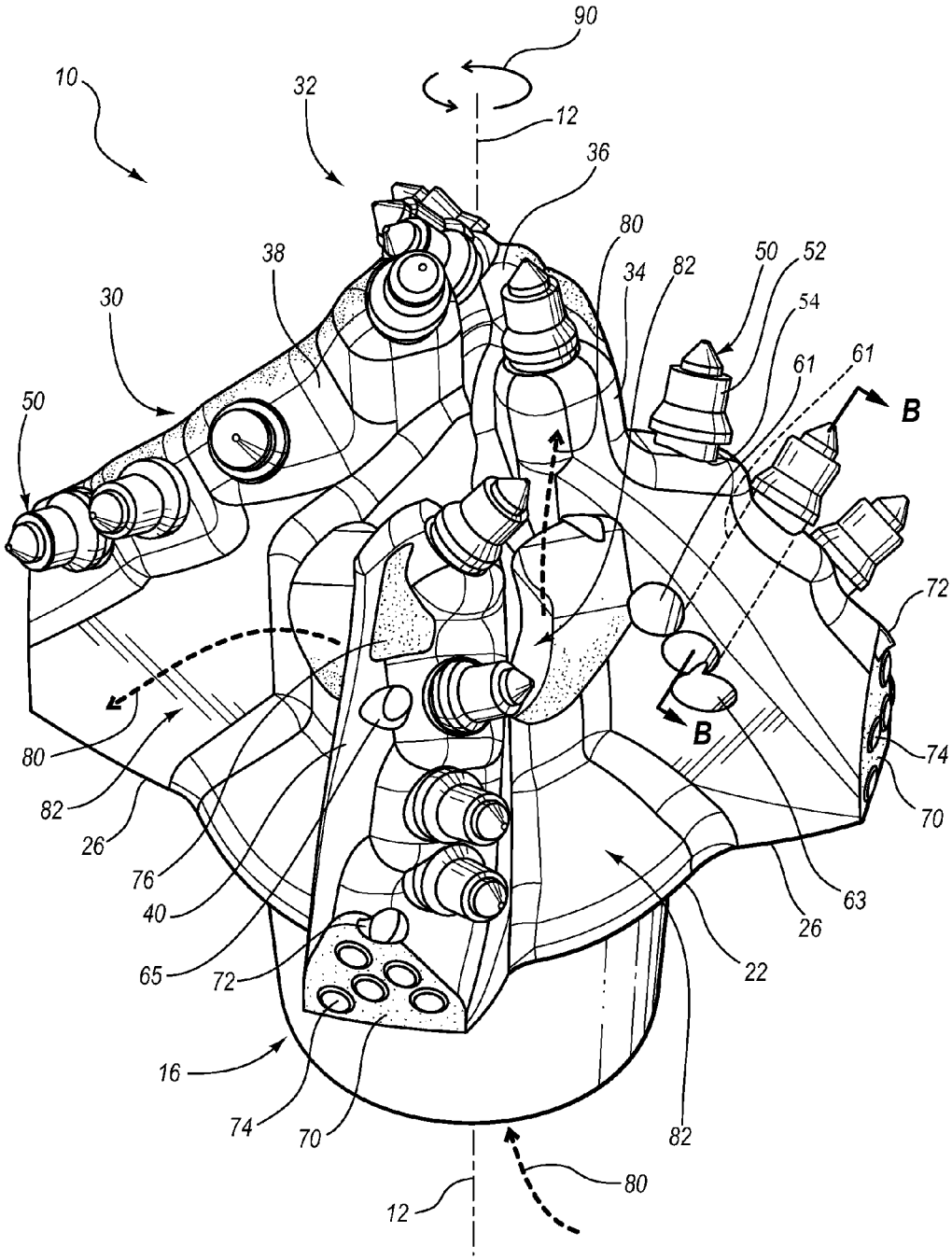
FIG. 3 is an isometric view of the embodiment of the drill bit illustrated in FIG. 1.

Returning to FIG. 3, optional elements included within the embodiment of drill bit 10 are illustrated. One or more backup cutters 65 are illustrated in FIG. 3 behind one or more cutters 50. While the backup cutter 65 is illustrated behind a cutter 50 located primarily in the blade flank section 28, backup cutters 65 can be positioned in the cone section 27 and the blade shoulder section 29. Thus, one or more backup cutters 65 can be positioned behind or in front of any selected cutters 50 on any selected blades 34, 36, 38, and 40 as illustrated in FIG. 3 and as discussed above and illustrated in FIG. 12.

The backup cutters 65 illustrated in FIG. 3 can be a polycrystalline diamond compact (PDC), tungsten carbide, natural or synthetic diamond, hardened steel, or other hard material, and typically only differ in size and orientation as discussed above with respect to FIGS. 12-14 as compared to the associated cutter 50. The backup cutter 65 can be positioned in a through hole and use a cutter of the type as described above, or it can be positioned in a pocket configured to receive the backup cutter 65 formed in the blades 32 and body 30 of the drill bit 10.

Another optional element illustrated in FIG. 3 is hardfacing 76, typically applied through welding or brazing, to various locations of the drill bit 10. Hardfacing is an extra-hard or durable treatment to improve wear resistance and typically is applied to gauge pads 70, as discussed above, and, optionally, to the blades 34, 36, 38, and 40 and around the cutters 50.

Figure 7:
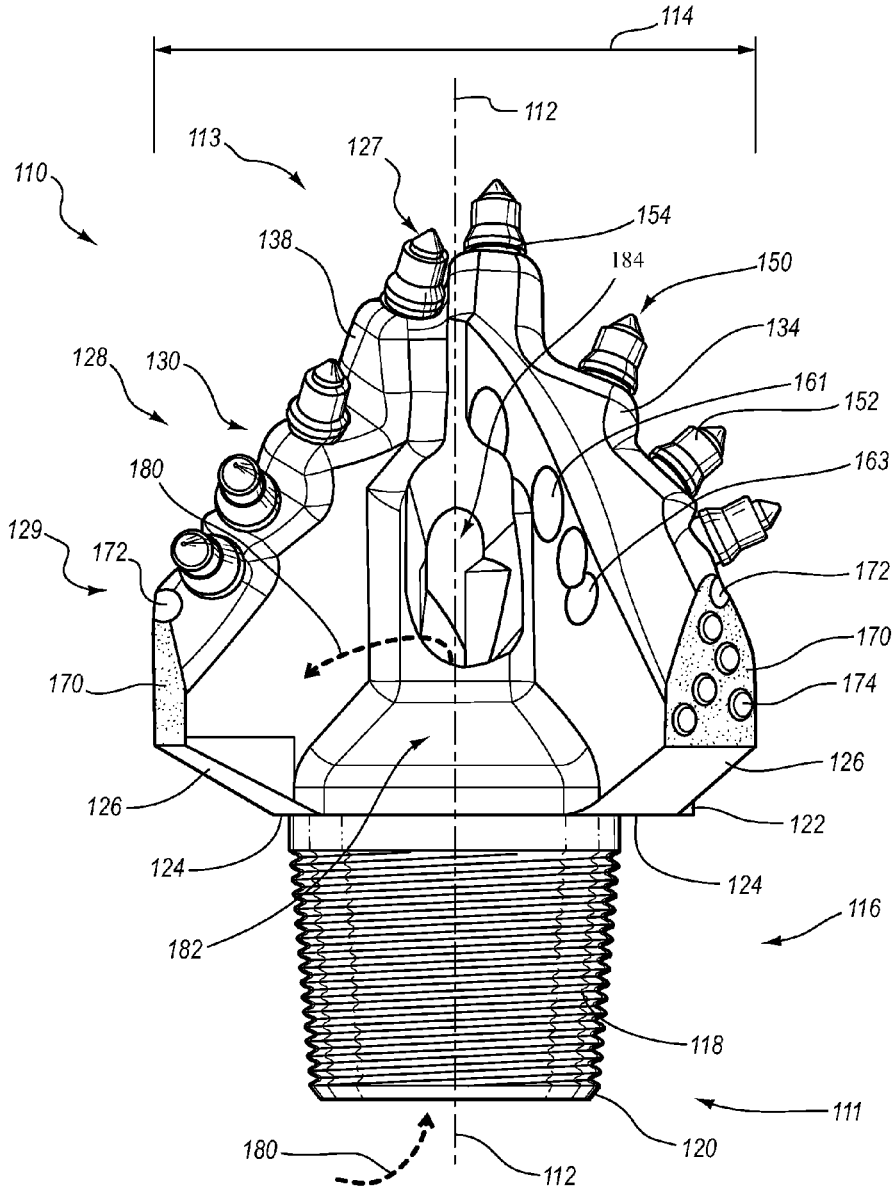
FIG. 7 is a side-view of another embodiment of a drill bit.
Figure 8:
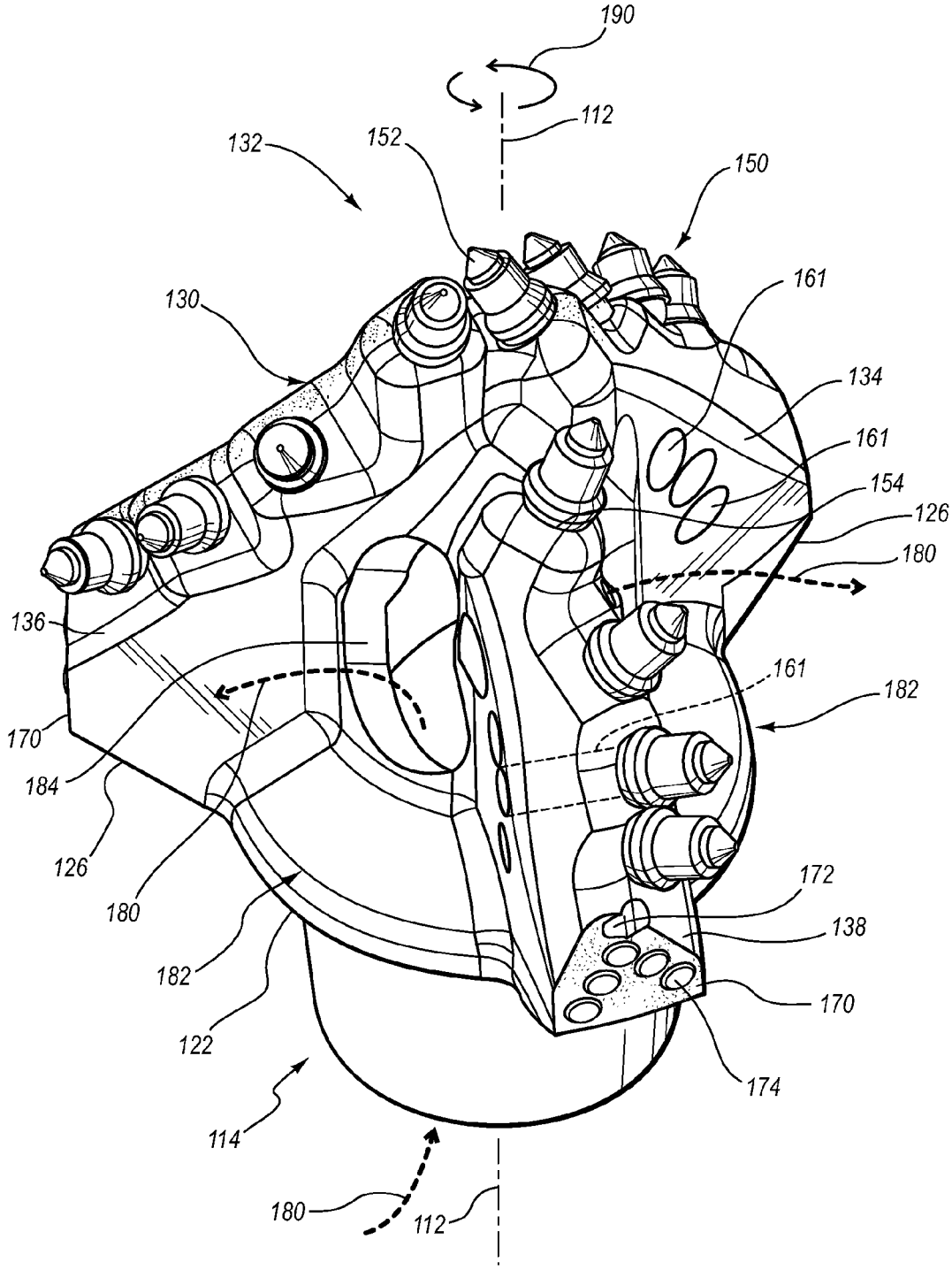
FIG. 8 is an isometric view of the embodiment of the drill bit illustrated in FIG. 7.
Figure 9:
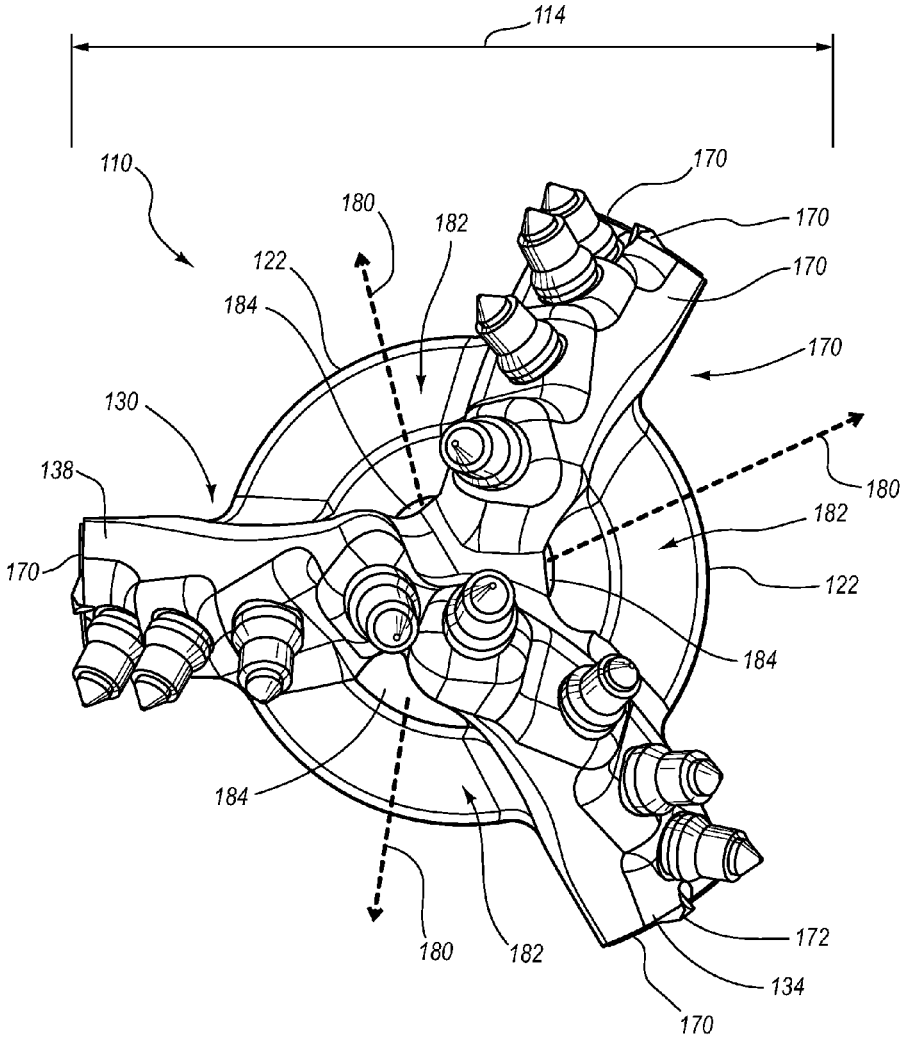
FIG. 9 is a top-view of the embodiment of the drill bit illustrated in FIG. 7.

Another embodiment of the invention is illustrated in FIGS. 7-9. The drill bit 110 includes a first end 111 having a pin connection 116 configured to couple the drill bit 110 to a drill string, as described above. Of course, box connections fall within the scope of the disclosures. The pin connection 116 includes a threads 118 that have a chamfer 120 configured to reduce stress concentrations at the end of the threads 118 and to ease mating with the box connection in the drill string, a shank shoulder 122, and the sealing face 124 of the connection. The threads typically are of a type described as an American Petroleum Institute (API) standard connection of various diameters as known in the art, although other standards and sizes fall within the scope of the disclosure. The threads 118 are configured to operably couple with the threads of a corresponding or analogue box connection in the drill string, collar, downhole motor, or other connection to the bit as known in the art. The sealing face 124 provides a mechanical seal between the drill bit 110 and the drill string and prevents any drilling fluid 180 passing through the inner diameter of the drill string and the drill bit 110 from leaking out.

The embodiments of the drill bit 110 optionally includes a breaker slot (not illustrated) configured to accept a bit breaker therein. The bit breaker is used to connect or mate the drill bit 110 to the drill string and provides a way to apply torque to the drill bit 110 (or to prevent the drill bit 110 from moving as torque is applied to the drill string) while the drill bit 110 and the drill string are being coupled together or taken apart.

The bit body 130 includes the drill bit blades 132 and is coupled to the connection 116. The bit body 130 can be formed integrally with the drill bit blades 132, such as being milled out of a single steel blank. Alternatively, the drill bit blades 132 can be welded to the bit body. Another embodiment of the bit body 130 is one formed of a matrix sintered under temperature and pressure, typically a tungsten carbide matrix with a nickel binder, with drill bit blades 132 also integrally formed of the matrix with the bit body 130. A steel blank in the general shape of the bit body 130 and the drill blades 132 can be used to form a scaffold and/or support structure for the matrix. The bit body 130 also can be formed integrally with the connection 116 from a steel blank or a steel connection 116 can be welded to the bit body 130.

The bit body 130 includes the one or more drill bit blades 132 connected thereto that extend past the bit body 130 in both a radial direction from the centerline 112 and a vertical direction towards and proximate to the second end 113 of the drill bit 110 as illustrated in FIG. 7, the bit body 130 being attached or fixedly coupled to the connection 116. The bit body 130 can be formed integrally with the drill bit blades 132, such as being milled out of a single steel blank. Alternatively, the drill bit blades 132 can be welded to the bit body. Another embodiment of the bit body 130 and blades 132 is one formed of a matrix sintered in a mold of selected shape under temperature and pressure, typically a tungsten carbide matrix with a nickel binder, with drill bit blades 132 also integrally formed of the matrix with the bit body 130. A steel blank in the general shape of the bit body 130 and the drill blades 132 can be used to form a scaffold and/or support structure for the matrix. The bit body 130 also can be formed integrally with the connection 116 from a steel blank or a steel connection 116 can be welded to the bit body 130.

The drill bit 110 includes one or more blades 132 that includes a cone section 127 within a first radius proximate the centerline 112 of the drill bit 110; a blade flank section 128 spaced laterally away at a greater radial distance from the centerline 112 than the cone section 127; a blade shoulder section 129 spaced further laterally away at a greater radial distance from the centerline 112 than the blade flank section 128; and a gauge (or gage) pad 170 proximate the greatest radial distance, or one-half the bit diameter 114 of the drill bit 110, from the centerline 112 and proximate the bit body 130. The gauge pad 170 optionally includes a crown chamfer 126 adjacent to the bit body 130.

The drill bit 110 with blades 132 is illustrated to have three distinct blades 134, 136, and 138 that are best illustrated in FIG. 9. Each of the blades 134, 136, and 138 is slightly different for the reasons that will be discussed below with respect to FIG. 15, including the shape of each blade and the placement of the cutters 150 along the blades. The blades 132 can have a shape selected for various factors, including the formation drilled, the size of the hole desired, the capability of the equipment (drilling rig, drill string, etc.), cost, and other considerations.

A particular embodiment of the drill bit 110 includes a plurality of blades 132 that have one or more cutters 150 located on each blade 134, 136, and 138. The cutters 150 are configured to pass at least partially through holes 161 that are configured to receive a cutter 150 as explained above. The cutters 150 are configured to be positioned within the through holes 161 and removed from the through holes 161 in a field location, such as a mine, oil rig, or other wellsite. In other words, the cutters 150 can be replaced in the drill bit in order to repair damaged or broken cutters 150, change one type of cutters 150 suitable for a particular geological formation or purpose for those of another type suitable for another geological formation or purpose. Thus, the purpose and capability of a particular drill bit 110 can be adjusted in the field by changing the cutters 150, making the drill bit 110 more cost-effective and useful.

The drill bit 110 optionally includes a gauge pad 170 positioned a radial distance from the centerline 112 of one-half of the gauge diameter 114. In other embodiments, the gauge pad 170 is positioned at a radial distance less than one-half of the gauge diameter 114. The gauge pad 170 optionally includes gauge protection 174, which can be hard-facing and/or a selected pattern of tungsten carbide, PDC, natural or synthetic diamond, or other hard materials to provide increased wear-resistance to the gauge pad 170 to increase the probability that the drill bit 110 substantially retains its gauge diameter 114. The gauge pad 170 also optionally includes a crown chamfer 126 that forms the transition between the gauge pad 170 and the bit body 130.

Drill bit 110 optionally includes one or more gauge cutters 172 positioned in the blade shoulder section 129 to provide backup to the cutters 150 at the greatest radial distance from the centerline 112 of the drill bit 110, similar to the backup cutter 465 described above in FIG. 12. Optionally, the gauge cutter 172 can be positioned behind or below a selected cutter 150 or on a separate or different gauge pad 170. The gauge cutter 172 typically is of a smaller size and/or diameter than the cutters 150, but the gauge cutter 172 can also be the same size and/or diameter or a larger size and/or diameter than the cutters 150. The gauge cutter 172 can be formed of tungsten carbide, PDC, synthetic or natural diamond, or other hard material, or combinations thereof.

Other features of the drill bit 110 include one or more nozzles, jets, or ports 184 formed as an integral part of the bit body 130. As illustrated the jets or ports 184 have a fixed area through which drilling mud 180 flows after passing through an inner diameter of the drill string and through the inner diameter or annulus of the drill bit 110, as discussed above. The nozzles, jets, or ports 184 optionally can be configured to accept jet nozzles of various sizes that are typically field replaceable to adjust the total flow area of the nozzles or ports 184. If the port 184 is configured to accept jet nozzles of different diameters, the port 184 optionally includes threads or other means to secure the jet nozzle in position as known in the art. The jet nozzles are typically field replaceable and have a selected diameter chosen to balance the expected rate-of-penetration and, consequently, the rate at which drill cuttings are created by the bit and removed by the drilling fluid, the necessary hydraulic horsepower, and capabilities of the drilling rig facilities, particularly the pressure rating of the drilling rig's fluid management system and the pumping capacity of its mud pumps, among other factors.

The flow path of the drilling fluid 180 is best illustrated in FIG. 9. As illustrated, the various jets or ports 184 have an orientation selected to enhance the removal of drill cuttings from the face of each blade 132 and from the cone section 127 of the bit and move them towards the annulus of the well-bore. Stated differently, the orientation of the jets or ports 184 is such that the drilling fluid 180 cleans the cutters 150 and the blades 134, 136, and 138 of the drill bit 110. While three nozzles or ports 184 exist, one between each blade 134, 136, and 138, either more or fewer nozzles, jets, or ports 184 can be used as selected for a given situation.

The drilling fluid 180 flows through the fluid channels or junk slots 182, which are sized and positioned relative to the blades 134, 136, and 138 based on the expected rate-of-penetration, characteristics of the geological formation, particularly hardness and whether the formation swells or expands in the presence of the drilling fluid used, average size of the formation cuttings created, and other factors known in the art. For example, smaller (i.e., narrower) fluid channels 182 result in a higher fluid velocity with the result that formation cuttings are carried away more easily and quickly from the drill bit 110. However, smaller fluid channels or junk slots 182 raise the risk that one or more of the fluid channels 182 would become blocked by the formation cuttings, resulting in premature or uneven wear of the bit, reduced rate-of-penetration, and other negative effects. Of course, as discussed above, the drilling fluid 80 can flow through the drill string and out the nozzles or ports 184 as is typical, or it can be reverse circulated down the annulus, into the nozzles or ports 184, and up the drill string.

Figure 10:
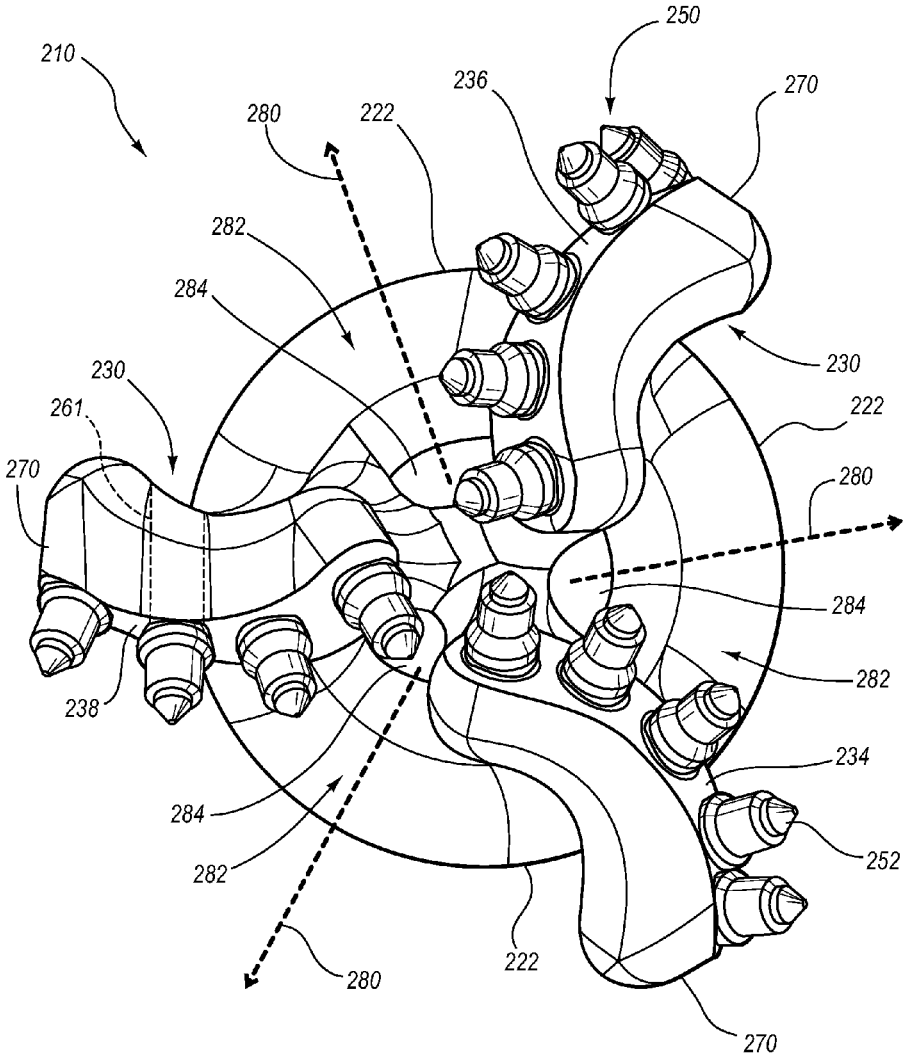
FIG. 10 is a top-view of another embodiment of a drill bit.

Another embodiment of the invention is illustrated in FIG. 10, which illustrates a top view of a three-bladed drill bit with a different shape of blade from that in FIG. 9. The drill bit 210 includes many of the same or similar elements as those previously described, therefore only those illustrated in FIG. 10 will be expressly identified.

The bit body 230 includes the drill bit blades 232 and is coupled to a connection as described above. The bit body 230 can be formed integrally with the drill bit blades 232, such as being milled out of a single steel blank. Alternatively, the drill bit blades 232 can be welded to the bit body. Another embodiment of the bit body 230 is one formed of a matrix sintered under temperature and pressure, typically a tungsten carbide matrix with a nickel binder, with drill bit blades 232 also integrally formed of the matrix with the bit body 230. A steel blank in the general shape of the bit body 230 and the drill blades 232 can be used to form a scaffold and/or support structure for the matrix. The bit body 230 also can be formed integrally with the connection from a steel blank or a steel connection can be welded to the bit body 230.

The bit body 230 includes the one or more drill bit blades 232 connected thereto that extend past the bit body 230 in both a radial direction from the centerline 112 and a vertical direction towards and proximate to the second end 13 of the drill bit 10 as illustrated in FIG. 1, the bit body 230 being attached or fixedly coupled to the connection.

The drill bit 210 with blades 232 is illustrated to have three distinct blades 234, 236, and 238. Each of the blades 234, 236, and 238 is slightly different for the reasons that will be discussed below with respect to FIG. 15, including the shape of each blade and the placement of the cutters 250 along the blades. The blades 232 can have a shape selected for various factors, including the formation drilled, the size of the hole desired, the capability of the equipment (drilling rig, drill string, etc.), cost, and other considerations. A comparison of FIGS. 9 and 10 will illustrate that the blades 232 in FIG. 10 have a radius of curvature that changes and becomes much smaller as the radial distance of a given point from the centerline of the drill bit 210 increases as compared to the drill blades 132 in FIG. 9. In other words, the blades 232 are more curved than the blades 132 in FIG. 9.

A particular embodiment of the drill bit 210 includes a plurality of blades 232 that have one or more cutters 250 located on each blade 234, 236, and 238. The cutters 250 are configured to pass at least partially through holes 261 that are configured to receive a cutter 250 as explained above. The cutters 250 are configured to be positioned with the through holes and removed from the through holes in a field location, such as a mine, oil rig, or other wellsite. In other words, the cutters 250 can be replaced in the drill bit in order to repair damaged or broken cutters 250, change one type of cutters 250 suitable for a particular geological formation or purpose for those of another type suitable for another geological formation or purpose. Thus, the purpose and capability of a particular drill bit 210 can be adjusted in the field by changing the cutters 250, making the drill bit 210 more cost-effective and useful.

The drill bit 210 optionally includes a gauge pad 270 positioned a radial distance from the centerline of one-half of the gauge diameter. In other embodiments, the gauge pad 270 is positioned at a radial distance less than one-half of the gauge diameter. The gauge pad 270 optionally includes gauge protection, which can be hard-facing and/or a selected pattern of tungsten carbide, PDC, natural or synthetic diamond, or other hard materials to provide increased wear-resistance to the gauge pad 270 to increase the probability that the drill bit 210 substantially retains its gauge diameter. The gauge pad 270 also optionally includes a crown chamfer that forms the transition between the gauge pad 270 and the bit body 230.

Drill bit 210 optionally includes one or more gauge cutters positioned in the blade shoulder section to provide backup to the cutters 250 at the greatest radial distance from the centerline of the drill bit 210, similar to the backup cutter 465 described above in FIG. 12. Optionally, the gauge cutter can be positioned behind or below a selected cutter 250 or on a separate or different gauge pad 270. The gauge cutter typically is of a smaller size and/or diameter than the cutters 250, but the gauge cutter can also be the same size and/or diameter or a larger size and/or diameter than the cutters 250. The gauge cutter can be formed of tungsten carbide, PDC, synthetic or natural diamond, or other hard material, or combinations thereof.

Other features of the drill bit 210 include one or more nozzles, jets, or ports 284 formed as an integral part of the bit body 230. As illustrated the jets or ports 284 have a fixed area through which drilling mud 280 flows after passing through an inner diameter of the drill string and through the inner diameter or annulus of the drill bit 210, as discussed above. The nozzles, jets, or ports 284 optionally can be configured to accept jet nozzles of various sizes that are typically field replaceable to adjust the total flow area of the nozzles or ports 284. If the port 284 is configured to accept jet nozzles of different diameters, the port 284 optionally includes threads or other means to secure the jet nozzle in position as known in the art. The jet nozzles are typically field replaceable and have a selected diameter chosen to balance the expected rate-of-penetration and, consequently, the rate at which drill cuttings are created by the bit and removed by the drilling fluid, the necessary hydraulic horsepower, and capabilities of the drilling rig facilities, particularly the pressure rating of the drilling rig's fluid management system and the pumping capacity of its mud pumps, among other factors.

The flow path of the drilling fluid 280 flows through the various jets or ports 284. As illustrated, the various jets or ports 284 have an orientation selected to enhance the removal of drill cuttings from the face of each blade 232 and from the cone section of the bit and move them towards the annulus of the well-bore. Stated differently, the orientation of the jets or ports 284 is such that the drilling fluid 280 cleans the cutters 250 and the blades 234, 236, and 238 of the drill bit 210. While three nozzles or ports 284 exist, one between each blade 234, 236, and 238, either more or fewer nozzles, jets, or ports 284 can be used as selected for a given situation.

The drilling fluid 280 flows through the fluid channels or junk slots 282, which are sized and positioned relative to the blades 234, 236, and 238 based on the expected rate-of-penetration, characteristics of the geological formation, particularly hardness and whether the formation swells or expands in the presence of the drilling fluid used, average size of the formation cuttings created, and other factors known in the art. For example, smaller (i.e., narrower) fluid channels 282 result in a higher fluid velocity with the result that formation cuttings are carried away more easily and quickly from the drill bit 210. However, smaller fluid channels or junk slots 282 raise the risk that one or more of the fluid channels 282 would become blocked by the formation cuttings, resulting in premature or uneven wear of the bit, reduced rate-of-penetration, and other negative effects. Of course, as discussed above, the drilling fluid 80 can flow through the drill string and out the nozzles or ports 284 as is typical, or it can be reverse circulated down the annulus, into the nozzles or ports 284, and up the drill string.

Figure 15:
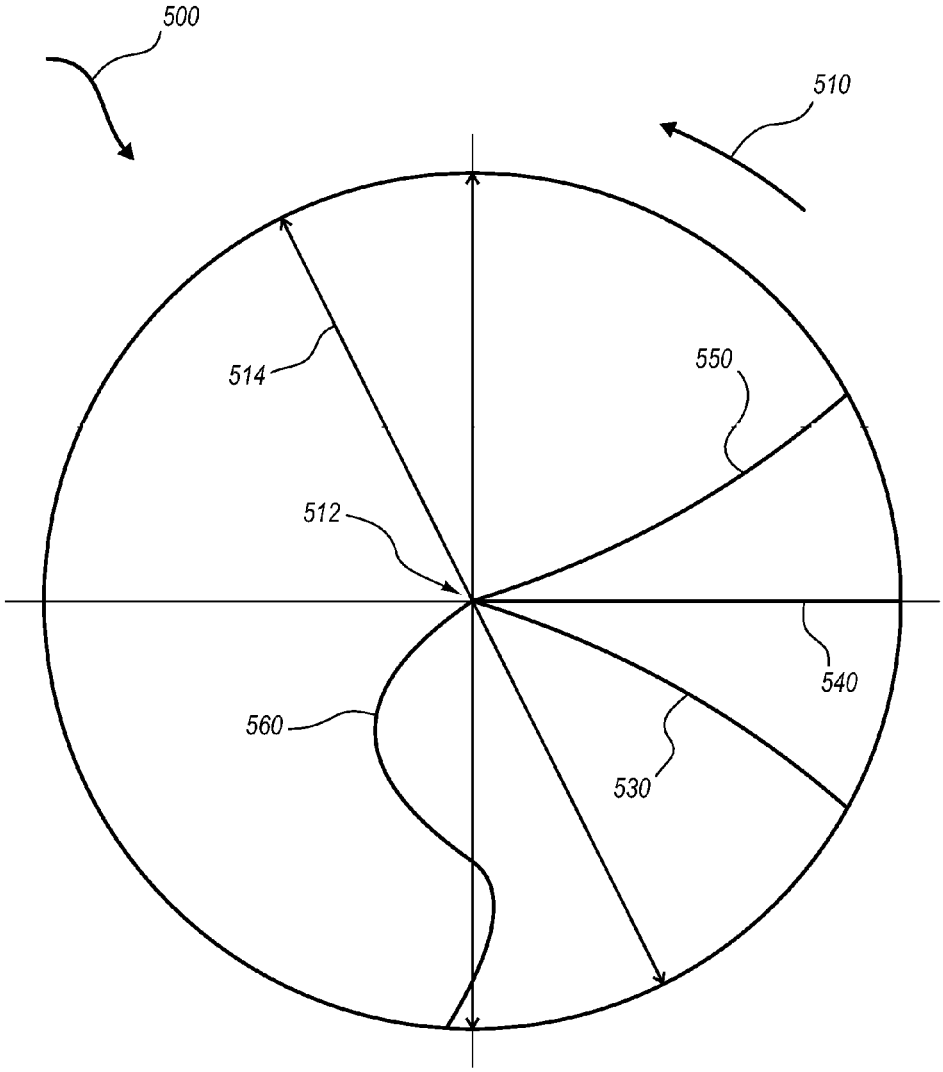
FIG. 15 is a top view of various embodiments of blade profiles of the embodiment of the drill bit illustrated in FIG. 1.

As an example of the types of blade profiles that fall within the scope of the disclosure, FIG. 15 illustrates several embodiments of blade shapes 500 with a gauge diameter 514 as if viewed by looking directly at the crown section 27 of the drilling bit 10 illustrated in FIG. 1. One embodiment of the blade shapes is a less aggressive blade shape 530 has a trailing radius of curvature relative to the direction of rotation 510. The trailing blade shape 530 is qualitatively the same as that of blades 32 illustrated in FIGS. 1-4. Straight blade 540 has no radius of curvature and is perpendicular to the direction of rotation 510 of the drill bit 10 and, therefore, is relatively more aggressive than the trailing blade shape 530. Another blade shape 550 has a leading radius of curvature. Thus, an exemplary drill bit may have a profile in which a plurality of blades that are not co-planar with a plane through a centerline 512 of said drill bit.

Of course, it will be understood that different blades in a given drill bit might have different blade shapes, either more or less aggressive, than any other given blade on the drill bit. Further, a blade shape need not remain constant, either straight or have a constant radius of curvature as its radial distance from the center of the bit increases. For example, blade shape 560 indicates a blade whose radius of curvature changes significantly as the radial distance from the center increases, from a trailing radius of curvature to a leading radius of curvature, something that might be suitable for drilling horizontal wells along very thin geological formations of different hardness.

Various profiles of embodiments of blades 32 are illustrated as lines 640; 650; 660; 670; 680; 690; and 695. The profiles 600 illustrate the aggregate profile of the blades 32. In other words, the blades 32, taken as a whole, would generally appear as the embodiment of the profiles 600 if all of the blades 32 were laid flat on a plane through the centerline 612. The centerline 612 in FIG. 16 centerline is an embodiment of the centerline 12 the drill bit 10 and the maximum diameter of the drill bit 10 is illustrated as the gauge diameter 614, which corresponds with the gauge diameter 14 illustrated in FIGS. 1 and 2.

Figure 16:
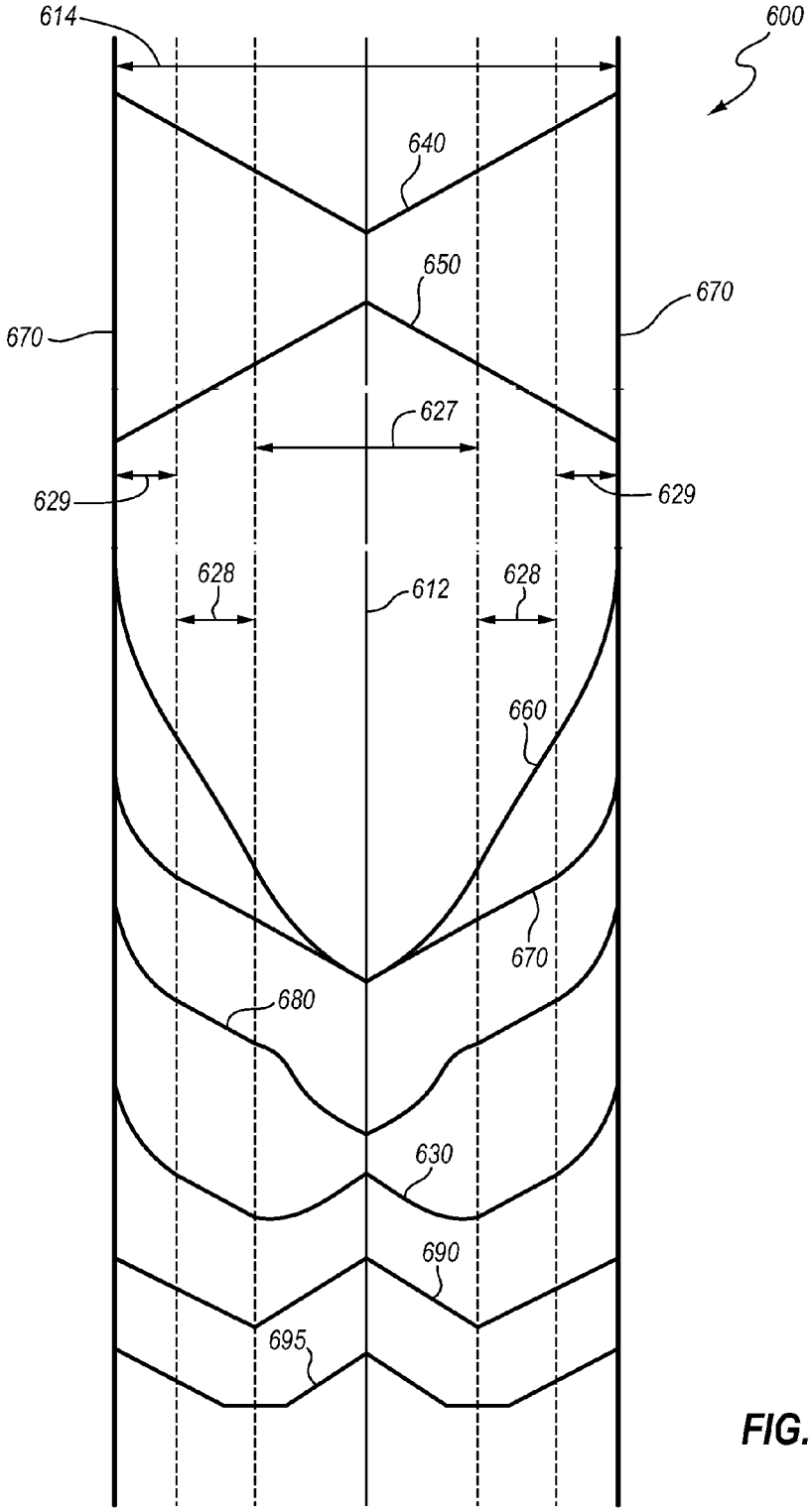
FIG. 16 is a side view of various embodiments of blade profiles of the embodiment of the drill bit illustrated in FIG. 1.

Still referring to FIG. 16, the cone section 27 of drill bit 10 generally falls within the cone diameter 627. Of course, it will be understood that the cone section 627 may extend slightly more or less than the cone diameter 627 as illustrated because the cone diameter 627 is shown for illustrative and qualitative purposes. In other words, the cone section 627 encompasses that portion of the blades 32 relatively closest to the centerline 612 of the drill bit 10.

The blade flank section 28 of the drill bit 10 falls within the blade flank section 628 illustrated adjacent to and at a further radial distance from the centerline 612 than the cone section 627 in FIG. 9. Of course, it will be understood that the blade flank section 628 may extend slightly more or less than the blade flank section 628 as illustrated because the blade flank section 628 is shown for illustrative and qualitative purposes. In other words, the blade flank section 628 encompasses that portion of the blades 32 relatively further from the centerline 612 than the cone section 627 but not as far as the blade shoulder section 629.

The blade shoulder section 29 of the drill bit 10 falls within the blade flank section 629 illustrated adjacent to and at a further radial distance from the centerline 612 than the cone section 627 and the blade flank section 628 in FIG. 16. Of course, it will be understood that the blade shoulder section 629 may extend slightly more or less than the blade shoulder section 629 as illustrated because the blade shoulder section 629 is shown for illustrative and qualitative purposes. In other words, the blade shoulder section 628 encompasses that portion of the blades 32 relatively further from the centerline 612 than the cone section 627 and the blade flank section 628 but not as far as the blade gauge section 670.

Looking at FIG. 16, the aggregate blade profiles 600 illustrate the varying profiles that fall within the scope of the disclosure. Blade profile 640 illustrates an embodiment of the aggregate blade profiles 34, 36, 38, and 40 of drill bit 10 that cone-shaped profile. Blade profile 695 illustrates an embodiment of the aggregate blade profiles that has a recessed, or negative, cone section 627, a relatively flatter blade flank section 628, and a negative blade shoulder section 629. Blade profile 690 is similar to that of blade profile 695, but with sharper transitions, whereas blade profile 680 has smoother transitions between the various sections. Other various profiles include 670, 660, and 650. Of course, it will be understood that embodiments of the blade profiles 600 include others than those illustrated as well as combinations of various sections of those illustrated.

Methods of building a drill bit that falls within the scope of the disclosure are also described. A bit body is formed with one or more drill bit blades connected thereto that extend past the bit body in both a radial direction from the centerline of the bit and a vertical direction towards and proximate to the second end 13 of the drill bit 10 as illustrated in FIG. 1. The bit body can be formed integrally with the drill bit blades, such as being milled out of a single steel blank. Alternatively, the drill bit blades can be welded to the bit body. Another embodiment of the bit body and blades is one formed of a matrix sintered in a mold of selected size and shape under temperature and pressure, typically a tungsten carbide matrix with a nickel binder, with drill bit blades also integrally formed of the matrix with the bit body. A steel blank in the general shape of the bit body and the drill blades can be used to form a scaffold and/or support structure for the matrix.

A selected number of blades are milled or molded to have a selected shape in consideration of various factors, including the geophysical properties of the formation to be drilled as described above. The blades may be symmetric or asymmetric relative to the drill bit body and to each other, as illustrated in the figures.

The bit body is attached, joined, or fixedly coupled to a connection, such as a pin connection described above, configured to connect the drill bit to a drill string, downhole motor, or other means of applying a rotary force or torque to the drill bit. The bit body also can be formed integrally with the connection from a steel blank or a steel connection can be welded to the bit body.

The inner annulus of the drill bit can be milled out of the connection. The nozzles, jets, ports, fluid channels and junk slots within the drill bit body, and one or more through holes in each of the drill bit blades configured to receive a cutter also can be milled out of the drill bit body. Alternatively, if the drill bit is formed from a matrix, special blanks may be placed within the mold at the location of the various features, such as the jets, nozzles, fluid channels, junk slots, and through holes with the matrix sintered about the blanks. Once the drill bit body is removed from its mold after the sintering process the blanks can be removed from the drill bit body, thereby revealing the desired hole or feature in the drill bit body. Any imperfections in the molding process can be removed through finish milling or other similar tool work.

Cutters configured to be received in the through holes in the drill bit blades are provided, the cutters and/or through holes including a means of securing the cutters within the through holes.

Optional features such as gauge or backup cutters are positioned in either pockets milled or molded to receive them. Hardfacing is optionally applied in various locations as described above, as is any selected gauge protection.

The one or more present inventions, in various embodiments, includes components, methods, processes, systems and/or apparatus substantially as depicted and described herein, including various embodiments, subcombinations, and subsets thereof. Those of skill in the art will understand how to make and use the present invention after understanding the present disclosure.

The present invention, in various embodiments, includes providing devices and processes in the absence of items not depicted and/or described herein or in various embodiments hereof, including in the absence of such items as may have been used in previous devices or processes, e.g., for improving performance, achieving ease and/or reducing cost of implementation.

The foregoing discussion of the invention has been presented for purposes of illustration and description. The foregoing is not intended to limit the invention to the form or forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Moreover, though the description of the invention has included description of one or more embodiments and certain variations and modifications, other variations and modifications are within the scope of the invention, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A drill bit for earth boring, said drill bit comprising:

a bit body having a first end and a second end spaced apart from said first end;

a connection means connected to said first end of the bit body for coupling said bit body to a rotation means for providing rotational torque to said bit body;

a plurality of blades connected to said bit body at least at said second end, each of said plurality of blades having a face including at least one through hole having an inside diameter, said at least one through hole passing through said blade and configured to receive a cutter shaft therein; and, at least one cutter having a shaft, said shaft having a shaft diameter less that said inside diameter and an axis, and said shaft being secured in said through hole and adapted to rotate about said axis when secured in said through hole.

2. The drill bit of claim 1, further comprising a removable securing device configured to secure said cutter within said hole.

3. The drill bit of claim 2, wherein said securing device is resilient.

4. The drill bit of claim 3, wherein said securing device is selected from at least one of a c-clip, spring ring, and an O-ring.

5. The drill bit of claim 1, wherein said drill bit has an axis of rotation and said plurality of blades each curve in a plane perpendicular to said axis of rotation.

6. The drill bit of claim 1, wherein said bit body is formed from at least one of sintered matrix and steel.

7. The drill bit of claim 1 wherein said blades have a cone section proximate a centerline of the drill bit and a blade section spaced laterally a greater distance from the center line than the cone section, wherein said cone section extends in a direction from the first end to the second end beyond the blade section.

8. The drill bit of claim 1 wherein said at least one cutter has a body portion having a body diameter greater than the inside diameter.

9. The drill bit of claim 8 wherein said at least one cutter has a shoulder between said body portion and said shaft, wherein said shoulder contacts said face.

10. The drill bit of claim 9 wherein said shoulder inhibits said body from insertion into the through hole.

11. A method of making a drill bit for earth boring, said method comprising:

forming a bit body having a first end and a second end spaced apart from said first end;

forming a plurality of blades connected to said bit body at least at said second end;

forming at least one hole that passes through at least one of said plurality of blades, said at least one hole configured to receive a cutter therein and secure said cutter in a rotatable configuration; and, forming a connection means connected to said bit body for coupling said bit body to a rotation means for providing rotational torque to said bit body.

12. The method of claim 11, wherein forming said plurality of blades further comprises forming said plurality of blades integrally with said bit body.

13. The method of claim 11, wherein forming said bit body further comprises forming said bit body from at least one of a sintered matrix and steel.

14. The method of claim 11, wherein forming said plurality of blades further comprises forming said plurality of blades to have a profile that is not co-planar with a plane through a centerline of said drill bit.

15. The method of claim 11, further comprising securing said cutter in said hole.

16. The method of claim 11, further comprising securing said cutter within said hole with a removable securing device.

17. The method of claim 11, further comprising securing said cutter within said hole with a resilient securing device selected from at least one of a c-clip, spring ring, and an O-ring.

18. A drill bit for earth boring, said drill bit comprising:

a bit body having a first end and a second end spaced apart from said first end;

a connection means connected to said first end of the bit body for coupling said bit body to a rotation means for providing rotational torque to said bit body;

a plurality of blades connected to said bit body at least at said second end, each of said plurality of blades having a face including at least one through hole having an inside diameter, said at least one through hole passing through said blade and configured to receive a cutter shaft therein; and, at least one cutter having a body and a shaft, said body having a body diameter greater than said inside diameter and said shaft having a shaft diameter less than said body diameter, said shaft being disposed in said through hole and said body extending away from said face.

19. The drill bit of claim 18 wherein said at least one cutter is adapted to rotate in said through hole.

20. The drill bit of claim 18 further comprising a retention mechanism and a shoulder formed between said shaft and said body, wherein said retention mechanism inhibits said at least one cutter from removal of the shaft from said through hole, and wherein said shoulder inhibits said at least one cutter from further insertion into said through hole.

* * * * *